US008215164B1

(12) United States Patent
Hussain et al.

(10) Patent No.: US 8,215,164 B1
(45) Date of Patent: Jul. 10, 2012

(54) SYSTEMS AND METHODS FOR MONITORING GROUNDWATER, ROCK, AND CASING FOR PRODUCTION FLOW AND LEAKAGE OF HYDROCARBON FLUIDS

(75) Inventors: Daniar Hussain, Johnstown, PA (US); James B Miller, Pittsburgh, PA (US); Jay Scott Roberts, Johnstown, PA (US); Frank William Cooper, Jr., Johnstown, PA (US); Ryan Abbott, Campbell, CA (US); Lou Crocco, Johnstown, PA (US); Steven G. Malliaris, Winnetka, IL (US)

(73) Assignee: HydroConfidence Inc., Johnstown, PA (US)

( * ) Notice: Subject to any disclaimer, the term of this patent is extended or adjusted under 35 U.S.C. 154(b) by 0 days.

(21) Appl. No.: 13/342,186

(22) Filed: Jan. 2, 2012

(51) Int. Cl.
*E21B 47/06* (2012.01)
*E21B 47/10* (2012.01)

(52) U.S. Cl. ..... 73/152.33; 73/152.57

(58) Field of Classification Search ..... 73/152.29, 73/152.33, 152.57, 152.31
See application file for complete search history.

(56) References Cited

U.S. PATENT DOCUMENTS 2,947,938 A * 8/1960 Bennett ..... 324/706
3,085,431 A * 4/1963 Yerman et al. ..... 73/204.16
3,443,434 A * 5/1969 Baker et al. ..... 73/202.5
3,454,094 A * 7/1969 Friedman et al. ..... 166/250.01
4,520,666 A * 6/1985 Coblentz et al. ..... 73/152.33
4,832,121 A * 5/1989 Anderson ..... 166/250.09
4,839,644 A * 6/1989 Safinya et al. ..... 340/854.3
4,850,431 A * 7/1989 Austin et al. ..... 166/308.1
5,363,094 A * 11/1994 Staron et al. ..... 340/854.6
5,531,112 A * 7/1996 Young et al. ..... 73/152.02
5,631,413 A * 5/1997 Young et al. ..... 73/152.29
5,767,680 A * 6/1998 Torres-Verdin et al. ..... 324/355
5,887,657 A * 3/1999 Bussear et al. ..... 166/336
6,009,216 A * 12/1999 Pruett et al. ..... 385/12
6,070,666 A * 6/2000 Montgomery ..... 166/308.1
6,176,323 B1 * 1/2001 Weirich et al. ..... 175/40
6,645,769 B2 * 11/2003 Tayebi et al. ..... 436/56
6,874,361 B1 * 4/2005 Meltz et al. ..... 73/152.32
6,957,574 B2 * 10/2005 Ogle ..... 73/152.48
6,980,929 B2 * 12/2005 Aronstam et al. ..... 702/188
6,988,547 B2 * 1/2006 Goodwin et al. ..... 166/53
6,997,256 B2 * 2/2006 Williams et al. ..... 166/250.03

(Continued)

OTHER PUBLICATIONS

"Hydraulic Fracturin Facts", web document, published Sep. 2010, pp. 1-4.*

(Continued)

*Primary Examiner* — John Fitzgerald
(74) *Attorney, Agent, or Firm* — American Patent Agency PC; Daniar Hussain; Ryan Abbott

(57) ABSTRACT

One embodiment of the present invention is a system comprising one or more subsystems, which can be practiced alone or in combination, which together allow for monitoring of groundwater, rock, and casing for production flow and leakage of hydrocarbon fluids. A flow measurement subsystem measures flow of hydrocarbons in the horizontal casing string. A well mechanical integrity monitoring subsystem monitors the mechanical integrity of the natural gas production well, including the junctures of a completed well. An aquifer monitoring subsystem directly monitors water aquifer (s) underneath and surrounding a natural gas production well or pad, including monitoring wells or existing water wells. A communication subsystem is used to communicate measurements taken downhole to the surface. The present invention may be used to enhance the production from a gas bearing shale formation, mitigate liability associated with hydrocarbon migration, and monitor for a loss of mechanical integrity of a well.

17 Claims, 13 Drawing Sheets

U.S. PATENT DOCUMENTS

| | | | | |
|---|---|---|---|---|
| 7,066,284 | B2 * | 6/2006 | Wylie et al. | 175/65 |
| 7,168,311 | B2 * | 1/2007 | Zisk et al. | 73/152.31 |
| 7,219,729 | B2 * | 5/2007 | Bostick et al. | 166/250.01 |
| 7,240,730 | B2 * | 7/2007 | Williams et al. | 166/250.03 |
| 7,278,325 | B2 * | 10/2007 | Fraser et al. | 73/861.07 |
| 7,398,680 | B2 * | 7/2008 | Glasbergen et al. | 73/152.12 |
| 7,409,858 | B2 * | 8/2008 | Dria et al. | 73/152.33 |
| 7,412,881 | B2 * | 8/2008 | Crawley et al. | 73/204.11 |
| 7,725,301 | B2 * | 5/2010 | Shah et al. | 703/10 |
| 2002/0169645 | A1 * | 11/2002 | Aronstam et al. | 705/7 |
| 2002/0179301 | A1 * | 12/2002 | Schultz et al. | 166/250.01 |
| 2003/0079878 | A1 * | 5/2003 | Pramann et al. | 166/278 |
| 2003/0205083 | A1 * | 11/2003 | Tubel et al. | 73/152.19 |
| 2004/0026076 | A1 * | 2/2004 | Goodwin et al. | 166/66.6 |
| 2004/0084180 | A1 * | 5/2004 | Shah et al. | 166/250.16 |
| 2004/0129418 | A1 * | 7/2004 | Jee et al. | 166/250.01 |
| 2004/0252748 | A1 * | 12/2004 | Gleitman | 374/130 |
| 2005/0012036 | A1 * | 1/2005 | Tubel et al. | 250/227.14 |
| 2005/0149264 | A1 * | 7/2005 | Tarvin et al. | 702/6 |
| 2005/0269093 | A1 * | 12/2005 | Sandberg et al. | 166/302 |
| 2006/0010987 | A1 * | 1/2006 | Fraser et al. | 73/861.07 |
| 2006/0065393 | A1 * | 3/2006 | Williams et al. | 166/250.03 |
| 2006/0233217 | A1 * | 10/2006 | Gleitman | 374/131 |
| 2006/0272809 | A1 * | 12/2006 | Tubel et al. | 166/250.01 |
| 2007/0213963 | A1 * | 9/2007 | Jalali et al. | 703/10 |
| 2007/0289740 | A1 * | 12/2007 | Thigpen et al. | 166/250.01 |
| 2008/0023196 | A1 * | 1/2008 | Crawley et al. | 166/250.01 |
| 2008/0137711 | A1 * | 6/2008 | Gleitman | 374/161 |
| 2008/0262737 | A1 * | 10/2008 | Thigpen et al. | 702/9 |
| 2009/0188665 | A1 * | 7/2009 | Tubel et al. | 166/250.01 |
| 2009/0276100 | A1 * | 11/2009 | Malki et al. | 700/282 |
| 2009/0283261 | A1 * | 11/2009 | Poitzsch et al. | 166/250.02 |
| 2009/0308616 | A1 * | 12/2009 | Wylie et al. | 166/380 |
| 2010/0032171 | A1 * | 2/2010 | Bali et al. | 166/402 |
| 2010/0078164 | A1 * | 4/2010 | Bostick et al. | 166/250.01 |
| 2010/0270038 | A1 * | 10/2010 | Looney et al. | 166/402 |
| 2011/0004352 | A1 * | 1/2011 | Wilde et al. | 700/282 |
| 2011/0266056 | A1 * | 11/2011 | Pop et al. | 175/50 |

OTHER PUBLICATIONS

"Pennsylvania Environmental Solutions Conservation, Alternative Energy, Sustainability," web document, published Aug. 17, 2009.*

Ramudo et al., "Hydraulic Fracturing—Effects on Water Quality," Dec. 12, 2010.*

EPA, "Plan to Study the Potential Impacts of Hydrauli Fracturing on Drinking Water Resources," Nov. 2011.*

Paul Huckabee, SPE, Shell Exploration and Production Company, "Optic Fiber Distributed Temperature for Fracture Stimulation Diagnostics and Well Performance Evaluation," SPE Hydraulic Fracturing Technology Conference, Jan. 19-21, 2009, The Woodlands, Texas, Society of Petroleum Engineers (2009). SPE Paper 118831-MS.

* cited by examiner

1002

1020

1040

SYSTEMS AND METHODS FOR MONITORING GROUNDWATER, ROCK, AND CASING FOR PRODUCTION FLOW AND LEAKAGE OF HYDROCARBON FLUIDS

FIELD OF THE INVENTION

This invention relates to a monitoring system for shale gas wells to measure flow of hydrocarbon fluids, to detect a loss of mechanical integrity, and to identify and fingerprint a source of contamination associated with a leaking shale gas well. In addition to shale gas wells, the present invention may be applied to other types of natural gas wells as well as to oil wells.

BACKGROUND OF THE INVENTION

Natural gas is a vital component of the world's energy supply. It is a major source of electricity generation, is a relatively clean automobile fuel, and is used in residential homes for cooking, heating and cooling. Natural gas is a combustible mixture of hydrocarbon gases formed primarily of methane, which in its pure form is colorless and odorless. It is found in reservoirs underneath the earth, often associated with oil deposits. The United States has vast resources of natural gas available for extraction, but until recent technological advances, the ability to access these resources was limited.

Hydraulic fracturing is a technique used to facilitate natural gas and oil recovery. It was first used commercially by Halliburton in 1949, but it did not become widely adopted until resent technological improvements rendered it more effective and cost-efficient. It is now used worldwide in tens of thousands of oil and natural gas wells. Fracturing permits gas recovery from unconventional reservoirs such as shale rock and coal beds, which may not otherwise be sufficiently porous and permeable to allow gas to flow from the rock into the wellbore at economically feasible rates. The process creates fractures in underground rock formations as highly pressurized hydraulic fracturing fluid is injected into the reservoir to force tiny cracks in the rock to release gas trapped inside. A typical horizontal well (such as those drilled for the Barnett, Marcellus or Haynesville Shales) uses 3 to 5 million gallons of fracturing fluid. Hydraulic fracturing fluid is comprised of 99.5% water and proppant. Proppant is a material that prevents fractures from closing when the injection is stopped; the material is usually grains of sand or ceramic. In addition to water and proppant, the fracturing fluid may contain hundreds of other chemical additives.

When extracting natural gas and other fluids from horizontal shale production formations, it is extremely valuable for the producer to know which portion of the formation, and which portion of the horizontal production pipe, is producing the natural gas ("flow measurement").

Furthermore, considerable controversy surrounds the environmental and health effects of natural gas extraction. Gas drilling can potentially result in contamination of groundwater, air pollution, and public exposure to natural gas and toxic chemicals. Groundwater contamination from oil and gas leaks has been identified as one of the most significant environmental threats facing the United States ("leakage detection").

Therefore, it would be a significant advancement in the state of the art to provide a system that addresses both the flow measurement problem and the leakage detection problem. Therefore, the present inventors have developed a system, method, and apparatus for monitoring groundwater, rock, and casing for production flow and leakage of hydrocarbon fluids.

It is against this background that the present invention was developed.

BRIEF DESCRIPTION OF THE INVENTION

Accordingly, one embodiment of the present invention is a system for monitoring flow of hydrocarbon fluids in a shale gas formation, the system comprising a communication subsystem and a sensor subsystem. The communication subsystem is used for transmitting data to surface and providing power to subsurface, comprising a plurality of casing pipe segments, each said casing pipe segment having a communication cable for transmitting data and power along a length of the casing pipe segment and an interconnect (electrical, magnetic, or electromagnetic) at each end of each casing pipe segment for transmitting data and power between adjacent casing pipe segments. The sensor subsystem is embedded in a horizontal lateral of the casing pipe segments and connected to the communication cable of the casing pipe segments, and used for measuring temperature and flow data and providing said temperature and flow data to the communication subsystem for transmission to surface. The sensor subsystem comprises one or more processors, at least two first flow semiconductor sensors, each first flow sensor located between adjacent fracture stages of said horizontal lateral, said first flow sensors adapted to measure relative flow between adjacent fracture stages, and at least two second flow semiconductor sensors, each second flow sensor located within a fracture stage between adjacent fracture clusters of said horizontal lateral, said second flow sensors adapted to measure relative flow between adjacent fracture clusters, wherein said first and said second flow sensors generate data on relative flow rates of hydrocarbons from each fracture stage and each fracture cluster.

Another embodiment of the present invention is the system described above, further comprising at least two third flow sensors, each third flow sensor located between adjacent fracture points of said horizontal lateral, said third flow sensors adapted to measure relative flow between adjacent fracture points.

Another embodiment of the present invention is the system described above, further comprising a mechanical integrity monitoring subsystem adapted to monitor for a loss of mechanical integrity of the casing pipe segments forming a freshwater casing.

Another embodiment of the present invention is the system described above, further comprising a flow sensor for measuring flux of hydrocarbons out of the casing pipe segments forming the freshwater casing, wherein the loss of mechanical integrity of the freshwater casing is detected by the measurement of flux of hydrocarbons out of the freshwater casing.

Another embodiment of the present invention is the system described above, further comprising at least one fourth flow sensor located at a bottom portion of the freshwater casing, and at least one fifth flow sensor located at a top portion of the freshwater casing, wherein the loss of mechanical integrity of the freshwater casing is detected by a difference in a flow rate measured at the top portion of the freshwater casing and a flow rate measured at the bottom portion of the freshwater casing.

Another embodiment of the present invention is the system described above, further comprising an aquifer monitoring subsystem adapted to monitor a water aquifer overlying the shale gas formation for hydrocarbon contaminants leaking from the casing pipe segments.

Another embodiment of the present invention is the system described above, further comprising a methane sensor adapted to monitor the water aquifer overlying the shale gas formation for methane leakage from the casing pipe segments.

Another embodiment of the present invention is the system described above, where the flow sensors are thermistors.

Another embodiment of the present invention is the system described above, where the flow sensors are negative temperature coefficient thermistors.

Another embodiment of the present invention is the system described above, where the flow sensors are positive temperature coefficient thermistors.

Yet another embodiment of the present invention is a system for monitoring flow of hydrocarbon fluids in a horizontal lateral production casing of a shale gas formation, the system comprising a communication subsystem and a sensor subsystem embedded in the horizontal lateral production casing and connected to the communication subsystem, the sensor subsystem comprising at least two flow semiconductor sensors, each first flow sensor located between adjacent fracture clusters of said horizontal lateral, said first flow sensors adapted to measure relative flow between adjacent fracture clusters; and one or more processors for measuring temperature and flow data from the two flow sensors and providing said temperature and flow data to the communication subsystem for transmission to surface, wherein said flow sensors generate data on relative flow rates of hydrocarbons from each fracture cluster.

Yet another embodiment of the present invention is a method for monitoring flow of hydrocarbon fluids in a shale gas well in order to optimize shale gas production, comprising the steps of (1) measuring at least a first relative temperature between adjacent fracture stages in a horizontal lateral of the shale gas well, said measurement taken between adjacent fracture stages of said horizontal lateral; (2) measuring at least a second relative temperature between adjacent fracture clusters in the horizontal lateral, said measurement taken within a fracture stage between adjacent fracture clusters of said horizontal lateral; (3) determining relative flow rates of hydrocarbons from each fracture stage and each fracture cluster using the first and the second relative temperature measurements; and (4) transmitting said flow rates to surface.

Another embodiment of the present invention is the method described above, also including the steps of measuring a flow rate at a bottom portion of a freshwater casing of the shale gas well; measuring a flow rate at a top portion of the freshwater casing; calculating a difference in the flow rate measured at the top portion of the freshwater casing and the flow rate measured at the bottom portion of the freshwater casing; and detecting a loss of mechanical integrity of the freshwater casing based on the calculated difference in flow rates.

Another embodiment of the present invention is the method described above, also including the steps of monitoring a water aquifer overlying the shale gas well for hydrocarbon contaminants leaking from the shale gas well via a hydrocarbon sensor installed in the water aquifer.

Other embodiments of the present invention will become apparent from the detailed description of the invention when read with reference to the accompanying drawings.

DETAILED DESCRIPTION OF THE INVENTION

Figure 1:
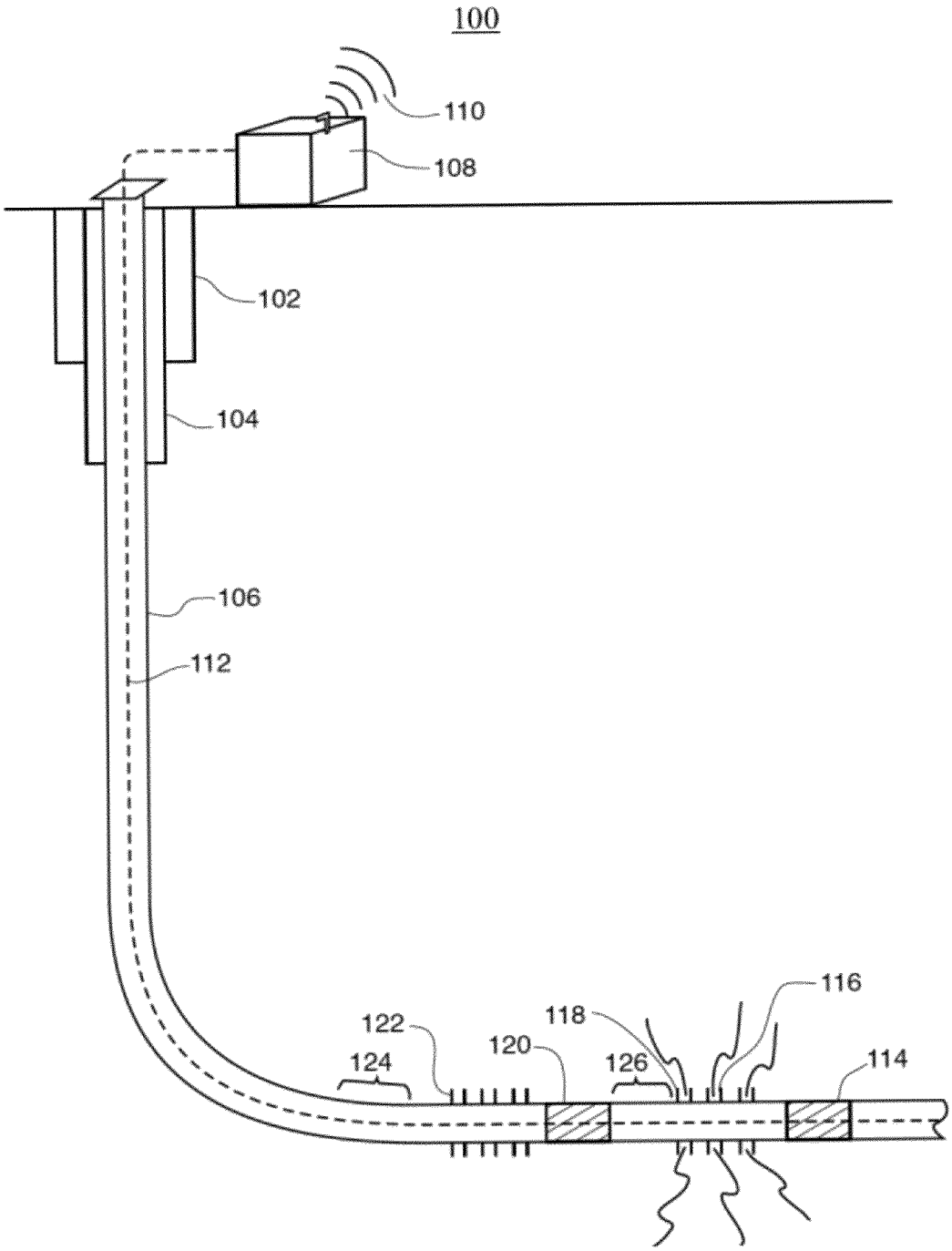
FIG. 1 is a cross section view of a typical gas production well, showing various casing strings and locations of horizontal flow sensors according to one embodiment of the present invention.

The system according to one embodiment of the present invention is composed of one or more subsystems, which can be practiced alone or in combination, which together allow for monitoring of groundwater, rock, and casing for production flow and leakage of hydrocarbon fluids. A flow measurement subsystem measures flow of hydrocarbons in the horizontal casing string. A well mechanical integrity monitoring subsystem monitors the mechanical integrity of the natural gas production well, including the junctures of a completed well. An aquifer monitoring subsystem directly monitors water aquifer(s) underneath and surrounding a natural gas production well or pad, including monitoring wells or existing water wells. A communication subsystem is used to communicate measurements taken downhole to the surface. The present system can be practiced with one or more of the disclosed subsystems. The rest of the disclosure describes each of these subsystems in detail.

Flow Measurement Subsystem

When drilling and extracting natural gas and other fossil-based materials from deep wells in the Marcellus Shale and other shale/oil/gas complexes, it is unknown from which fracs/fissures in the rock the gas is being produced from. Knowledge of the location from which gas production originates enables the resource extractor to optimize the recovery process. Existing flow measurement systems can measure gross flow at the wellhead. While it is possible to deploy temporary sensors down the pipe, this necessarily disrupts the flow profile. Deployment of temporary sensors is both expensive and time-consuming since it involves shutting down the production well for a significant period of time. In addition, fiber optic flow sensing technology is expensive, and does not have the resolution to measure individual frac points. As a result, it is usually done in only 1-2% of production wells, most often to validate assumptions about underground geology.

One embodiment of the system disclosed herein allows a gas producer to measure the flow and concentration of gas, produced water, and gas condensate (three-phase flow) of the producing formation, continuously and in real-time, without disturbing the production of gas by appropriate placement of sensors as shown and described in relation to FIG. 4B below. One preferred embodiment of the system comprises miniaturized thermal conductivity flow sensors, a downhole communications subsystem, and a data collection and analysis center.

Typically for a shale drilling operation, a small pad would facilitate multiple extraction heads that would be first drilled vertically and then transverse drilled into the shale formation below the well head, covering an anticipated area of several thousands of square feet, extending up to 1 mile in radial direction away from the well head. Thus, for a given well, one could assume a circular pattern of gas extraction extending up to 1 mile in radius from the well head.

Accordingly, in one embodiment of the present invention, permanent flow sensors are installed along the horizontal portion of the casing, along with a communication channel that can monitor these sensors continuously and in real-time (see communication subsystem). In one embodiment of the invention, the flow sensors are semiconductor-based flow sensors. In one embodiment, NTC (negative temperature coefficient) flow sensors are used. In an NTC flow sensor, the resistance of a resistor is inversely (negatively) proportional to the temperature. As the flow of gas over the surface of the sensor dissipates heat from the conductor, the temperature of the conductor drops, and the resistance increases. In a PTC (positive temperature coefficient) flow sensor, the relationship of temperature and resistance is positively correlated. Accordingly, accurate fluid flow measurements may be obtained using a simple and inexpensive sensor. These sensors may be distributed along the horizontal section of the casing to obtain flow profile measurements. According to one embodiment, an innovation of the present invention is appropriately placing the flow sensors along the sections of the casing where the fracking is being performed, and inferring from the relative flow measurements the source of the natural gas flow.

Accordingly, disclosed herein is a system comprising a series of down-well probes placed in the horizontal section of the production well that can measure gas flow, primarily methane, as illustrated schematically in FIG. 1. The sensors comprise thermal conductive flow sensors, which can be miniaturized to, for example, one-square-millimeter in size with a thickness of less than 1/10th of a millimeter (see FIG. 3B). The sensors communicate their data via a communication channel installed in the pipe (see communication subsystem), and are connected above ground to a communications control and power box that provides for real-time communications capability.

One unique attribute of this system is a completely integrated distributed network of low cost sensors embedded into the horizontal section of the shale pipe. If the sensors are installed at the beginning of the drilling process, then a baseline would be available and the gas owner can use the baseline data together with the continuous data to plan future drilling operations. An important benefit of the system disclosed is the ability to plan future hydraulic fracturing and drilling operations.

Sensors that accurately measure relative concentrations of hydrocarbon constituents (e.g., methane, ethane, propane, butane), produced salt water, and gas condensate liquid provide a more fine-tuned knowledge of reservoir production. If, in addition, a microseismic survey is performed, detailed knowledge of gas flow paths and production paths can be ascertained. Therefore, the sensors will also generate data on underground geology to provide a map of natural gas flows, which will facilitate future drilling operations. There is substantial value in collecting, maintaining, and interpreting this data over time.

A variety of sensors are contemplated to be within the scope and spirit of the present invention. One particularly compact flow sensor is a thermal conductive flow sensor. Examples of such sensors are manufactured QUALITY THERMISTORS INC.™ (QTI), GENERAL ELECTRIC® Measurement and Control Solutions Division, PYROMATION INC.®, MEASUREMENT SPECIALTIES™, THERM-O-DISC®, U.S. SENSOR CORP™, and RESISTANCE TECHNOLOGY INC.™, among others. It should be understood by one of ordinary skill in the art that the NTC thermal conductive flow sensor is just one sensor type which may be used in the present invention, and that other sensor systems are within the spirit and scope of the present invention.

FIG. 1 shows a cross section view 100 of a typical gas production well, showing the various casing strings and locations of the horizontal flow sensors according to one embodiment of the present invention. Conductor pipe 102, freshwater casing 104, and production casing 106 are installed as shown. In addition, other casing strings, including intermediate casing (not shown) may be used. A datalogger 108 located at the surface is used to transmit collected data to a central server (not shown) via a communication channel 110, which may be wired, wireless, or any other communication means known in the art. A downhole communication channel 112, representing the communications subsystem (described below), is shown as a dotted line 112.

When fracturing a portion of the shale casing, a plug 114 is first placed in the horizontal casing. Then, explosives (not shown) are used to break through the casing (including the metal pipe and cement) creating a series of holes 118. Next, high-pressure hydraulic fracturing fluid is injected into the well, causing fractures 116 to form, approximately 100-200 feet from the shale casing. In a typical Marcellus shale operation, six fractures are performed in a single "cluster," and three clusters are performed per "stage," with a separation of approximately 100 feet between each cluster. The stages are continued throughout the length of the horizontal casing. For example, a second plug 120 is placed upstream of the first stage. Once again, explosives (not shown) are used to break through the casing creating a second series of holes 122. Next, high-pressure hydraulic fracturing fluid is injected into the well, causing additional fractures to form from holes 122.

According to one embodiment of the invention, local flow sensors are placed at location 126 between the first and second stage, and location 124 between the second stage and the next subsequent stage. Furthermore, local flow sensors can also be placed in between each fracture hole 118. In another embodiment of this invention, local flow sensors are placed in location 116 within the first stage, or within subsequent stages, to monitor the breakout of fracking fluid into the surrounding formation. In yet another embodiment of this invention, sensors placed between the stages may be used to monitor the integrity of the plugs during the fracking process.

Figure 2:
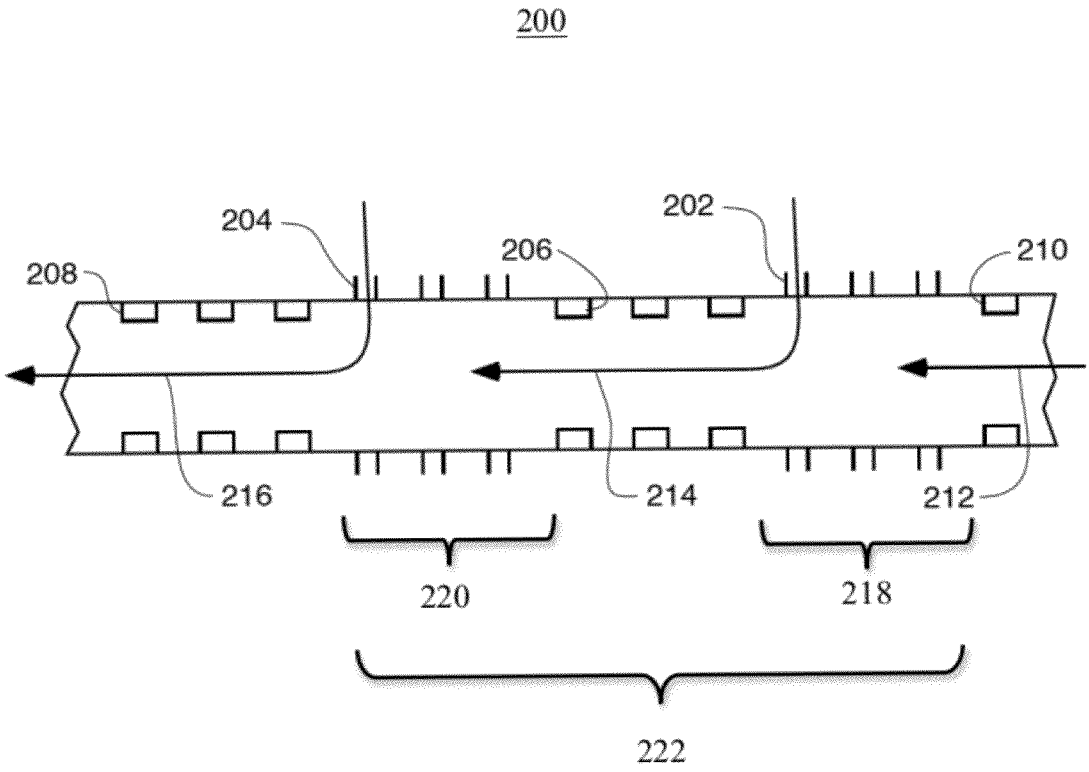
FIG. 2 is a zoomed-in cross section view of the horizontal portion of the well of FIG. 1, showing various gas flow pathways and locations of the horizontal flow sensors according to one embodiment of the present invention.

FIG. 2 shows a zoomed-in cross section view 200 of the horizontal portion of the well of FIG. 1, showing the various gas flow pathways and locations of the horizontal flow sensors according to one embodiment of the present invention. The explosives created casing holes 202 and 204 as described above. Furthermore, first flow sensor 206 positioned in between first cluster 218 and second cluster 220 is used to determine relative flow rate 214 coming from hole 202 relative to the flow rate 216 coming from hole 204. Similarly, flow sensor 208 is positioned upstream of the second cluster 220 and the next subsequent cluster (not shown), and can be used to determine relative flow rate 216 from hole 204 relative to an upstream flow rate. Analogously, flow sensor 210 positioned downstream of the first cluster 218 can be used to determine relative flow rate 212 coming from downstream of the first cluster 218 relative to flow rate 214 coming from hole 202. One or more fracture points or holes (e.g., 202 and 204) form a fracture cluster (e.g., 218 and 220). In turn, one or more fracture clusters (e.g., 218 and 220) form one or more fracture stages (e.g., 222). Whereas only illustrative sensor placement locations have been shown in FIG. 2, it will be understood by one of ordinary skill that multiple and numerous sensors may be placed in between the fracture stages (e.g., 222 and the next subsequent stage), facture clusters (e.g., 218 and 220), and fracture points or holes (e.g., 202 and 204) in order to determine relative local flow rates.

Figure 3A:
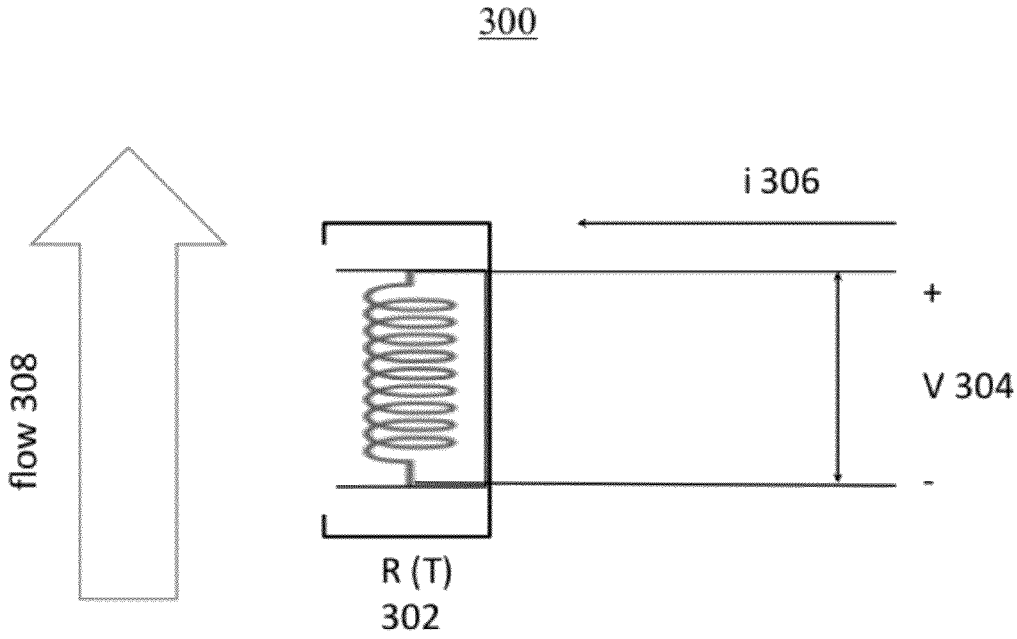
FIG. 3A is a schematic representation of a thermistor flow sensor.

FIG. 3A is a schematic representation 300 of a thermistor flow sensor. A thermistor element 302 whose resistance changes with temperature, R(T), is used as a flow sensor. Supplying a voltage V 304 to the thermistor is used to set it at its "zero-flow" operating temperature, and then recording its current draw (i) 306. Fluids that flow 308 past the thermistor 302 will cool it, causing its resistance R(T) to increase. The current draw (i) 306 at constant input voltage V 304 decreases. The amount of cooling that occurs depends on both flow rate 308 and the thermal properties of the fluid. The operation of an NTC thermistor flow sensor is illustrative only and is not intended to limit the scope of the present invention.

Figure 3B:
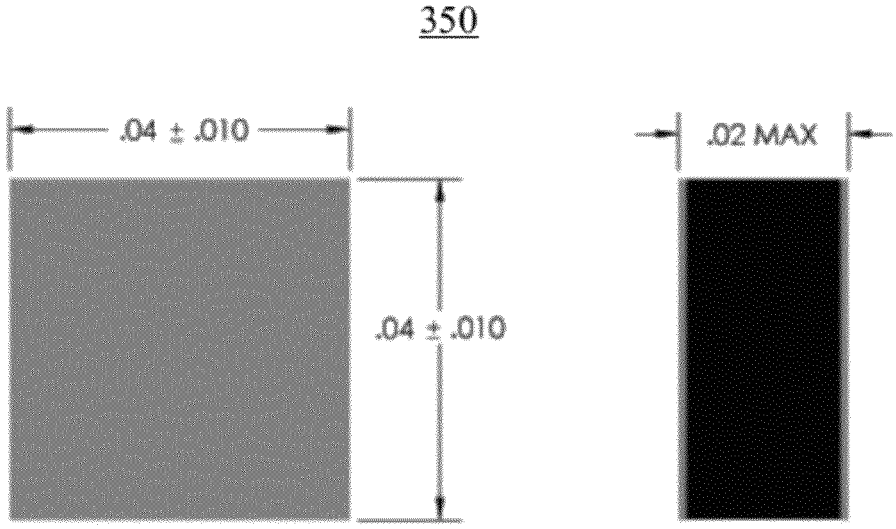
FIG. 3B illustrates a packaging of a thermistor flow sensor, according to one embodiment of the present invention.

FIG. 3B illustrates a packaging 350 of a thermistor flow sensor according to one embodiment of the present invention. The sizes and dimensions (in inches) shown in FIG. 3B are illustrative only and are not intended to limit the scope of the present invention. The rectangular surface mount arrangement of the thermistor facilitates fluid flow measurements.

Figure 4A:
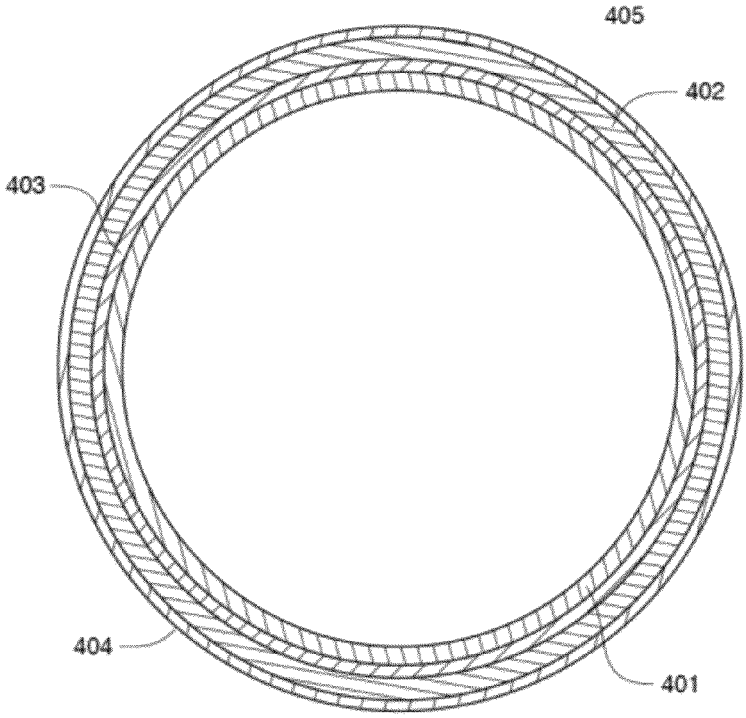
FIG. 4A shows a plane view of a casing string segment showing sensor placement.

FIG. 4A shows a plane view of a casing string segment showing sensor placement according to one embodiment of the present invention. The plane view is essentially looking down on the casing pipe showing the relationship between the casing pipe, the cement in the annulus, and the host rock outside the hole. The casing is composed of steel pipe 403 and cement 402 surrounded by the host rock formation 405 (not drawn to scale). Sensors can be embedded inside 401 of the steel pipe 403 as shown schematically in FIG. 4A. The sensors are in contact with fluids (not shown) flowing through the interior of the steel pipe 403. In an alternative embodiment of the present invention, the sensors are placed on the outside 404 of the cement 402, in contact with the reservoir fluids. FIG. 4A shows sensors encircling the casing but other potential configurations are possible including, but not limited to, sensors in quadrants and detection chambers with a single sensor.

Figure 4B:
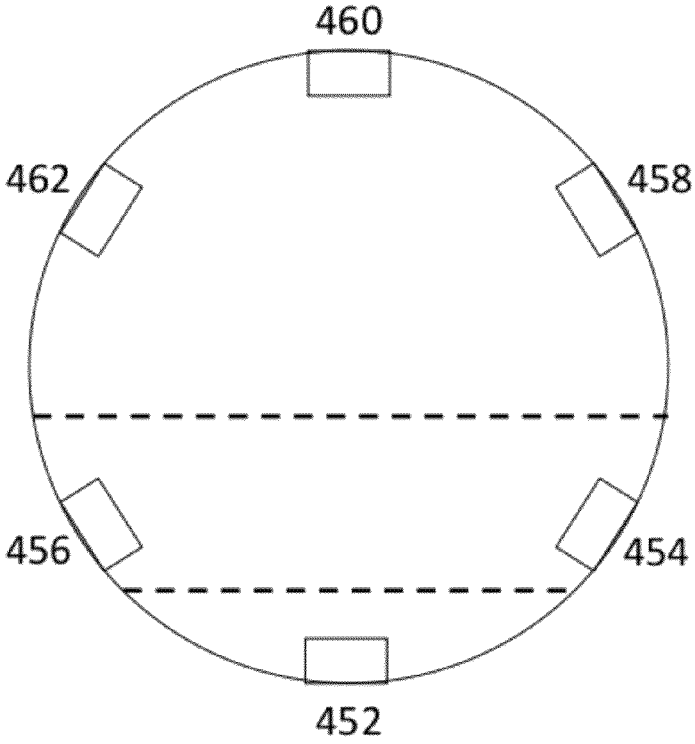
FIG. 4B shows a second plane view of a horizontal casing string segment showing sensor placement, according to two embodiments of the present invention.

FIG. 4B shows a plane view of a horizontal casing string segment showing flow sensor placement according to a second embodiment of the present invention. In one embodiment, a flow and concentration of gas, produced water, and gas condensate (three-phase flow) of the producing formation can be measured by appropriate placement of sensors as shown in FIG. 4B. Sensor 452, located at a gravity bottom of the horizontal casing is likely to encounter dense fluids, such as produced water. Meanwhile, sensors 454 and 456 are likely to encounter less dense fluids, such as gas condensate or light oil. Finally, sensors 458, 460, and 462 are likely to encounter the least dense fluids, such as methane gas. The dashed lines in FIG. 4B represent approximate separations between the three phases. The sensors can be placed symmetrically at any appropriate density, as shown in FIG. 4A for a very dense sensor placement, and in FIG. 4B for a less dense placement. Once the casing is inside the formation, the flow and temperature measurements from the sensors can be used to estimate approximately the locations of the dashed lines in FIG. 4B, and hence infer the relative concentrations and flow rates of the three phases likely present in a formation: gas (mostly methane), gas condensate (or light oils), and produced water.

As described above, thermistors are available in two varieties, NTC (negative temperature coefficient) and PTC (positive temperature coefficient). In one embodiment using the QUALITY THERMISTOR INC.™ (QTI) thermistors, the NTC thermistor is constructed of ceramics composed of oxides of transition metals (manganese, cobalt, copper, and nickel). With a current excitation, the NTC has a negative temperature coefficient that is very repeatable and fairly linear. These temperature dependent semiconductor resistors operate over a range for −100° C. to 450° C. Combined with the proper packaging, they have a continuous change of resistance over temperature. This resistive change versus temperature is larger than for an RTD (Resistive Temperature Device), consequently the thermistor is systematically more sensitive.

If it is assumed that the relationship between resistance and temperature is, then the following relationship holds, as shown in Equation 1.

$$\Delta R = k\Delta T \tag{1}$$

where ΔR=change in resistance, ΔT=change in temperature, and k=first-order temperature coefficient of resistance.

If k is positive, the resistance increases with increasing temperature, and the device is called a positive temperature coefficient (PTC) thermistor. If k is negative, the resistance decreases with increasing temperature, and the device is called a negative temperature coefficient (NTC) thermistor. Resistors that are not thermistors are designed to have the smallest possible k, so that their resistance remains almost constant over a wide temperature range.

In some circumstances, the linear approximation of Equation 1 works only over a small temperature range. For more accurate temperature measurements, the resistance/temperature curve of the device must be described in more detail. The Steinhart-Hart equation is a widely used third-order approximation, as shown in Equation (2).

$$\frac{1}{T} = a + b\ln(R) + c\ln^3(R) \tag{2}$$

where a, b and c are called the Steinhart-Hart parameters, and must be specified for each device. T is the temperature in Kelvin and R is the resistance in ohms. This equation can be easily solved for T as a function of the resistance R. The error in the Steinhart-Hart equation is generally less than 0.02° C. in the measurement of temperature.

Figure 11A:
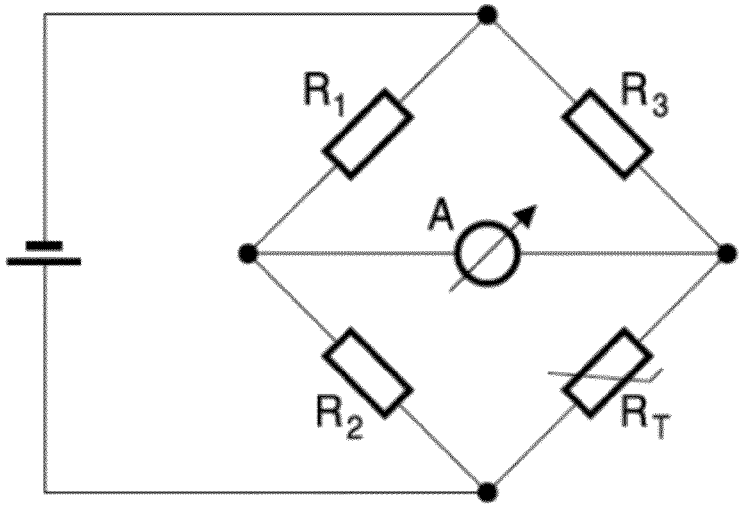
FIGS. 11A-D show several illustrative circuit diagrams of various embodiments of the present invention.

In practice, instead of measuring the resistance directly as shown in FIG. 3A, a "Wheatstone bridge" is used, comprising a thermistor with three resistors connected to a voltage source arranged in a bridge configuration as shown in FIG. 11A, in order to obtain an accurate reading of the resistance of the thermistor. A Wheatstone bridge is an electrical circuit used to measure an unknown electrical resistance by balancing two legs of a bridge circuit, one leg of which includes the unknown component, which in this case corresponds to the resistance of the thermistor. In FIG. 11A, $R_T$ is the unknown resistance of the thermistor to be measured; $R_1$, $R_2$ and $R_3$ are resistors of known resistance and the resistance of $R_2$ is adjustable. If the ratio of the two resistances in the known leg ($R_2/R_1$) is equal to the ratio of the two in the unknown leg ($R_T/R_3$), then the voltage between the two midpoints will be zero and no current will flow through the ammeter A. If the bridge is unbalanced, the direction of the current indicates whether $R_2$ is too high or too low. $R_2$ is varied until there is no current through the ammeter, which then reads zero.

Detecting zero current with a galvanometer can be done to extremely high accuracy. Therefore, if $R_1$, $R_2$ and $R_3$ are known to high precision, then $R_T$ can be measured to high precision. Very small changes in $R_T$ disrupt the balance and are readily detected. At the point of balance, the ratio of $R_2/R_1=R_T/R_3$, and $R_T$ can be easily calculated.

Alternatively, if $R_1$, $R_2$, and $R_3$ are known, but $R_2$ is not adjustable, the voltage difference across or current flow through the ammeter can be used to calculate the value of $R_T$, using Kirchhoff's circuit laws. This setup is recommended, as it is usually faster to read a voltage level off a meter than to adjust a resistance to zero the voltage.

Figure 11B:
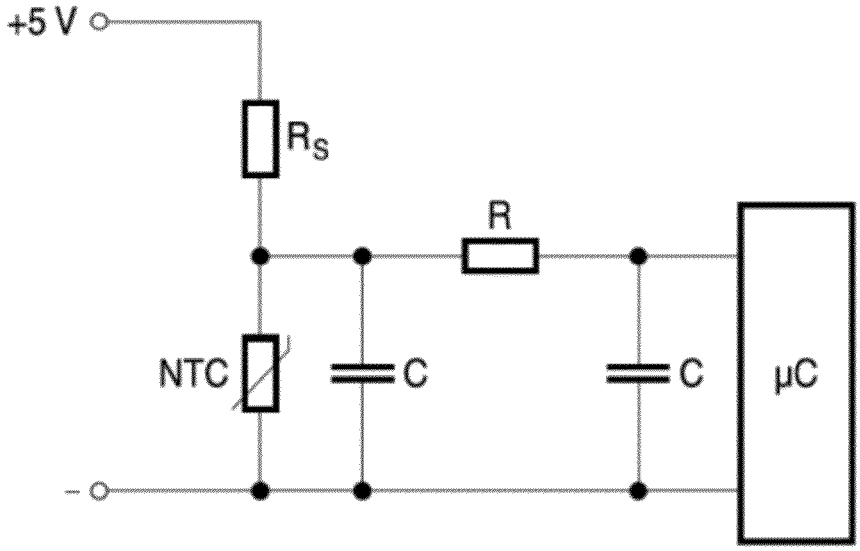

After the resistance is measured, it needs to be conditioned and converted into a digital value, for example using an A/D convertor and a microcontroller. An example of a circuit including an NTC thermistor and a microcontroller is shown in FIG. 11B. A microcontroller suitable for operation under the high temperature and extreme environments associated with downhole conditions is required. Examples of such microcontrollers are manufactured by MICROCHIP TECHNOLOGY INC.™, including the 8-bit PIC18F4680 and the 16-bit PIC24HJ16GP304. FIG. 11B shows a schematic diagram of an alternative bridge configuration for an NTC thermistor, connected to a microcontroller.

In one embodiment, measurement of gas or liquid flow with NTC thermistors can be implemented using the following illustrative approach. This method utilizes a self-heated thermistor to monitor the heat dissipation capacity of a fluid, and a second thermistor is employed to compensate for any variation in temperature of the fluid stream.

A thermistor's dissipation constant is measured in mW/° C., i.e. the amount of power the thermistor can dissipate which will raise the temperature of the device by 1° C. This will change depending on the thermistor's environment (still gas, moving gas, water, oil, etc.). If a thermistor under constant power (self-heated) is placed in different environments, the resistance of the thermistor will change as the amount of heat withdrawn from the device changes. This property is utilized to measure the flow of a fluid over the thermistor. In this embodiment, a second, unheated thermistor is placed in the fluid stream to compensate for changes in the fluid temperature and thus the dissipation capacity of the medium.

The heated thermistor should be hotter than the fluid. The compensation thermistor should be in close proximity to the heated thermistor without being affected by the heat from the thermistor. Larger (higher dissipation constant) thermistors are more robust, while smaller (lower dissipation constant) thermistors have faster time response.

Figure 11C:
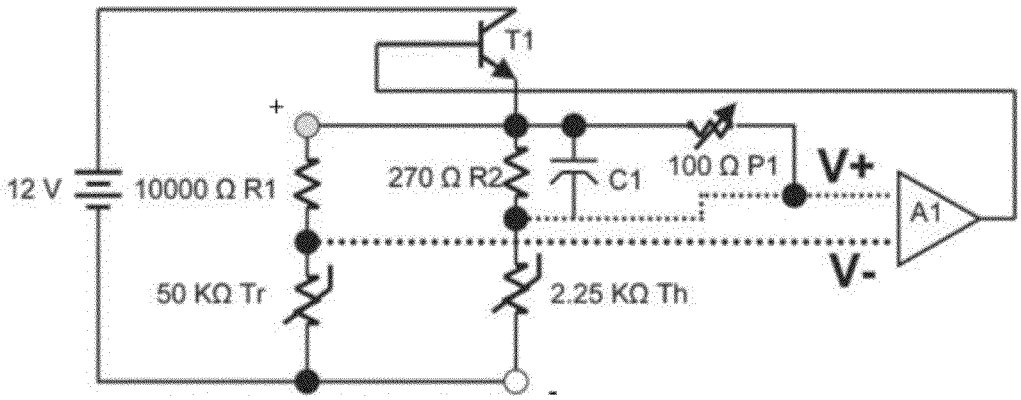

FIG. 11C shows a simple implementation of another illustrative circuit to measure fluid-flow according to one embodiment of the present invention. In FIG. 11C, Tr is a reference thermistor for the reference temperature, and Th is a self-heated thermistor for the flow measurement. R1 is a bridge resistor for the reference thermistor Tr, and R2 is a bridge resistor for the heated thermistor Th. C1 is an optional 10 uF capacitor, P1 is a 100 Ohm potentiometer, A1 is a 741 operational amplifier (op-amp), and T1 is an NPN transistor, such as transistor 2N3904. The transistor T1 and resistor R2 form a simple current source. R2 is selected to produce a current sufficient to self-heat thermistor Th to the desired temperature. Resistor R1 is a voltage-dropping resistor of a value large enough to minimize heating in the reference thermistor Tr. The voltage difference between the + and − terminals shown in FIG. 11C is proportional to the fluid flow over thermistor Th.

The thermistors may be applied to the inside of the casing pipe, either during the manufacture of the pipe, or soldered on after manufacture. Good thermal contact with the flowing fluid should be ensured, so materials with high thermal conductivity constants should be used as shielding for the thermistor. At the same time, care should be taken to ensure that the shielding provides good protection from the downhole environment. The thermistors and associated control circuitry should then be connected to the communication cable of the communication subsystem (described in greater detail below) by an electrical interconnect as appropriate.

According to the manufacturer QTI, the electronic ceramics and dielectrics utilized in the surface mound device (SMD) thermistors make them fragile and must be handled with care during installation. SMD thermistors should be handled with appropriate tools specifically designed for this purpose. When removing devices from the waffle pack packaging, non-metallic tweezers should be used. Automated equipment should not place stresses on the component. While robust, the termination finish consists of a soft solderable or gold outer layer. This layer may become marred or damaged by excessive force or handling. QTI SMD thermistors perform well in reflow soldering operations using standard low temperature eutectic solders, such as SN63. The gradual increase of temperature allows the component body temperature to rise gradually, resulting in proper solder junctions and reducing any stresses that may occur. Thermistors which contain a tin/lead plate on the terminations outperform those that do not in solderability requirements, however care must be taken to ensure proper solder paste dispensing, especially if a "low profile" component is used, to reduce any tensile stresses on the component. During a reflow soldering operation, the component body temperature is allowed to rise gradually prior to solder reflow; however in a hand solder operation, there is typically no preheat and the component is subjected to a thermal shock which may result in a fractured component. If hand soldering is necessary, a greater than 150° C. temperature difference between the thermistor and the soldering iron is not recommended prior to solder iron contact. A pre-heat of the component should diminish any possibility of thermal shock occurring.

Figure 11D:
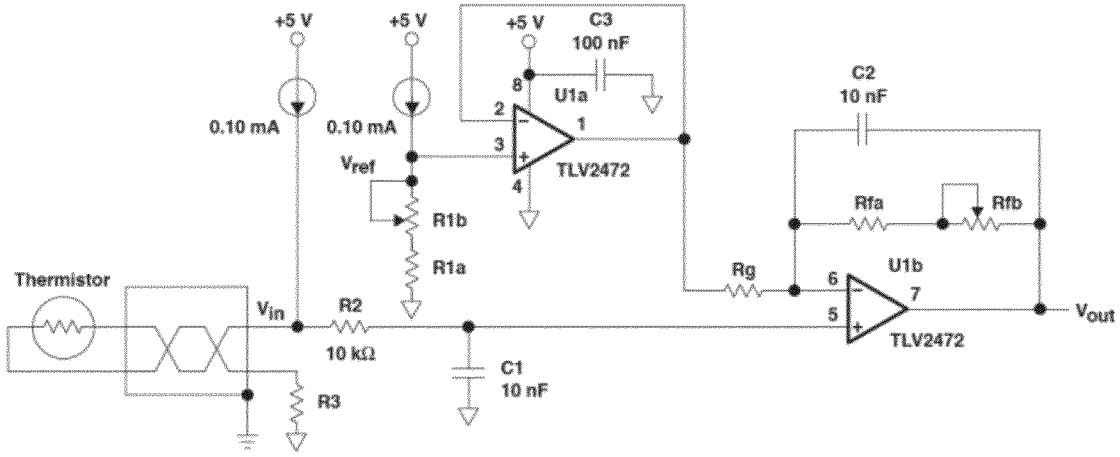

FIG. 11D shows a schematic diagram of a circuit according to yet another embodiment of the present invention. The thermistor used in this example is a thermistor manufactured by Resistance Technology Inc. (RTI part number ACC-004). It has a resistance of 32,650 Ohms at 0° C. and 678.3 Ohms at 100° C. capable of temperature measurement with a precision of ±0.2° C. When less precision is required, other parts are available at a lower cost (e.g., RTI part number ACC-024 with a precision of ±1° C.). In this embodiment, the thermistor may be operated in a constant-current mode, with a small constant current (100 uA) supplied by a current regulator/current source, such as a TI Tuscon REF200, which contains two current regulators and a current mirror (the current minor is not used). This device is useful for configuring regulated-current sources of varying magnitudes.

One of the two current regulators supplies 100 uA±0.5% to the thermistor. From resistance and current information, the thermistor voltage at 100° C. is 0.06783 V, and at 0° C. it is 3.265 V. Because any current used by the input to the amplifier affects the measured signal, an amplifier with high input impedance is recommended. The number of components in a circuit should be kept to a minimum because each component in the circuit increases cost, circuit errors, and complexity. Because fewer components are required to make a non-inverting amplifier, versus an inverting amplifier (with high input impedance), the non-inverting configuration was chosen. The output of the ADC is fed into a digital signal processor (DSP) where it is inverted if necessary.

As shown in FIG. 11D, in combination with R1*a*, R1*b* and U1*a*, the other current regulator is used to establish the reference voltage. The temperature of the thermistor is converted into a voltage that is increased by R3 and amplified by U1*b*. The resistor R3 is used because it forces a higher reference voltage. This reference voltage is developed by R1 and buffered by U1*a*. The higher reference voltage causes the output to move closer to the negative rail at the 100° C. point.

The analog-to-digital (ADC) convertor was selected to be the TLV2544 ADC for this application. The device is a single-supply unit with an analog input range of 0-5 V. The amplified sensor signal should completely fill this span. The voltage required to power this device is from a single 5-V supply. Other ADC devices could be used with corresponding changes in input range, resolution and input impedance considerations.

Operational-amplifiers (op-amps) are needed for converting and conditioning signals from the thermistors into signals that other devices, especially analog-to-digital converters (ADC), can use. The reason any conversion or conditioning is necessary is that the range and offset of the thermistor and the ADC are rarely the same.

Op amp U1*a* is a unity-gain amplifier whose output is the same voltage (but at a lower impedance) as its input. The nominal voltage for $V_{ref}$ is 67.83 mV (thermistor voltage at 100° C.) plus $V_{R3}$ (the resistance of R3 multiplied by 100 mA). With R3 set at 3.01 kOhm, $V_{ref}$ is calculated to be 0.406 Volts.

The other op amp, U1*b*, is used to amplify and filter the signal from the thermistor. Rf for U1*b* is found to be 15.056 kOhm, assuming Rg=26.7 kOhm (a 1% value). The closest 1% value for Rf is 15 kOhm.

Using the equation for a basic voltage divider allows calculation of $V_{ref}$ at 100° C. Substituting values for $R_{100° C.}$, $I_{sensor}$, $Vout_{100° C.}$, Rg and Rf gives $V_{ref}$=0.406 V. From Ohm's law, the value of R1 is 4.59 k (1% resistor).

Because the temperature coefficient of potentiometers is higher (worse) than that of resistors, it is wise to replace R1 and Rf with a potentiometer in series with a resistor. These parts are designated R1*a* and Rfa for the fixed resistors and Rfb and R1*b* for the potentiometers. In addition, when a fixed resistor is used in series with a potentiometer, adjustment is less critical. Between now and the end of an application's life, component values will drift as the components age. Therefore, when calculating values of Rf and R1, the life expectancy should be taken into account.

When a transducer is connected to an input, the wiring is subjected to noise because of the electrical and magnetic environment surrounding the transducer and wiring. To prevent this noise from interfering with the measurements, some shielding is necessary. Noise can be reduced by using a twisted pair from the transducer to the conversion circuit, and shielding this pair (grounding the shield only at the instrument). Without an input filter, the op amp will act as a radio frequency detector converting high-frequency signals from other devices into signals that will have low-frequency components. Putting a resistor and capacitor on the input forms a low-pass filter that prevents high-frequency signals from interfering with the temperature signal. The cutoff frequency of an RC filter is calculated; for R2=10 kW and C1=10 nF, $F_C$ is about 1600 Hz.

When resistor Rf (15 kOhm) and capacitor C2 (10 nF) are connected from the output of U1*b* to its non-inverting input, a low-pass filter is created. The purpose of this filter is to remove any noise generated by the components in this circuit as well as noise that was of low enough frequency to get past the previous filter. Additionally, it removes any frequency that is near or above the sampling frequency of the ADC and which would otherwise cause alias signals. The cutoff frequency of this filter is calculated to be 1060 Hz.

Power supply decoupling is important to prevent noise from the power supply from being coupled into the signal being amplified, and vice-versa. This is accomplished using a 6.8 mF tantalum capacitor in parallel with a 100 nF ceramic capacitor on the supply rails, as shown in FIG. 11D. The tantalum capacitor can be shared between multiple packages but one ceramic capacitor should be connected as close as possible (preferably within 0.1 inch) to each package.

Figure 12:
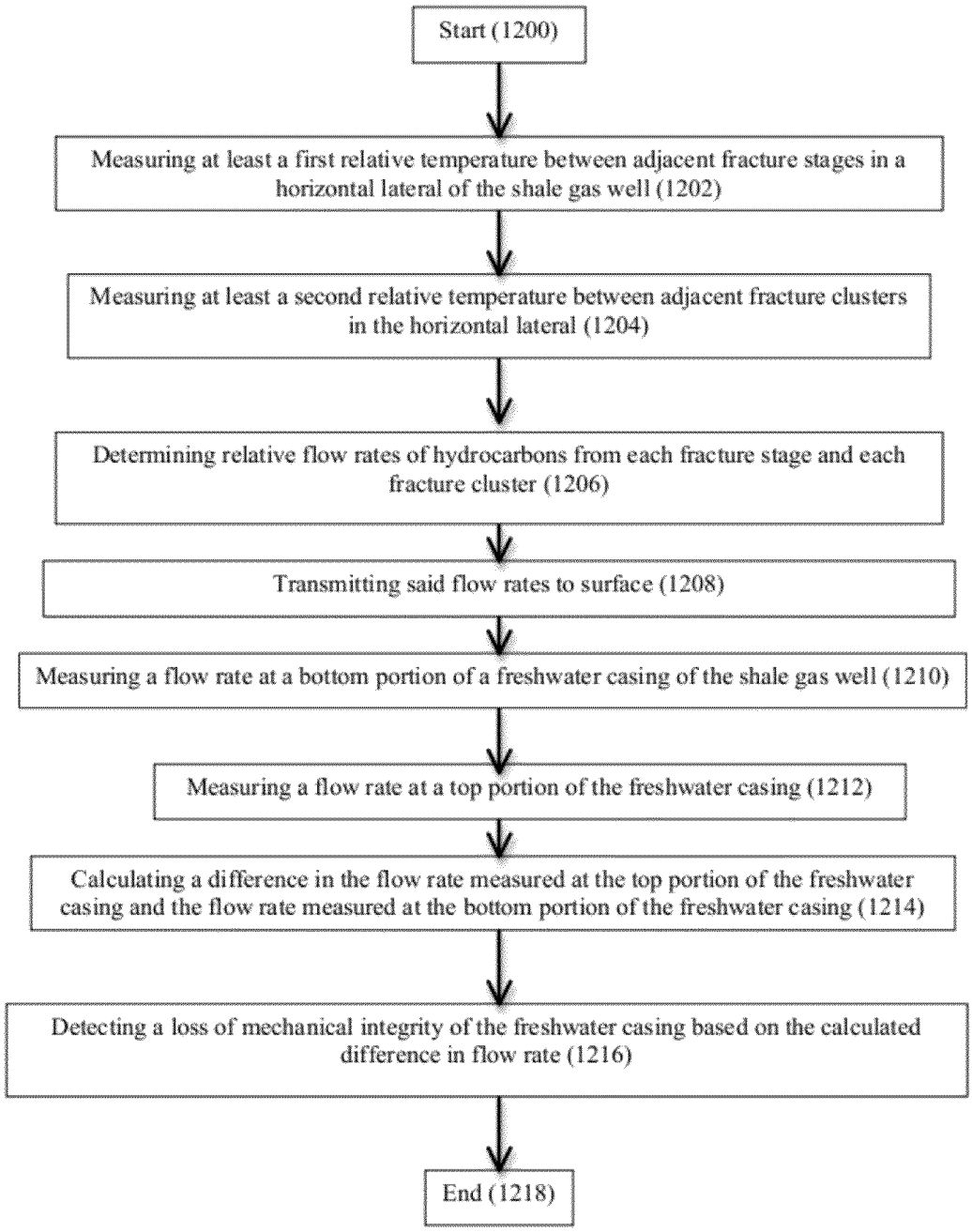
FIG. 12 shows a flowchart of a method according to yet another embodiment of the present invention.

FIG. 12 shows a flowchart of a method for monitoring flow of hydrocarbon fluids in a shale gas well in order to optimize shale gas production according to yet another embodiment of the present invention. As shown in FIG. 12, the method starts in step 1200. In step 1202, a measurement is performed of at least a first relative temperature between adjacent fracture stages in a horizontal lateral of the shale gas well, said measurement taken between adjacent fracture stages of said horizontal lateral. In step 1204, a measurement is performed of at least a second relative temperature between adjacent fracture clusters in the horizontal lateral, said measurement taken within a fracture stage between adjacent fracture clusters of said horizontal lateral. In step 1206, a determination is made of relative flow rates of hydrocarbons from each fracture stage and each fracture cluster using the first and the second relative temperature measurements. Finally, the flow rates are transmitted to surface as shown in step 1208.

As shown in FIG. 12 and according to one embodiment of the present invention, a measurement is taken of a flow rate at a bottom portion of a freshwater casing of the shale gas well, as shown in step 1210. In step 1212, a measurement is taken of a flow rate at a top portion of the freshwater casing. In step 1214, a calculation is performed of a difference in the flow rate measured at the top portion of the freshwater casing and the flow rate measured at the bottom portion of the freshwater casing. Finally, a determination may be made of a loss of mechanical integrity of the freshwater casing based on the calculated difference in flow rates, as shown in step 1216. The process of FIG. 12 ends in step 1218.

Other embodiments of the present invention correspond to the methods corresponding to the processes carried out by the systems described in this application, as will be apparent to one of ordinary skill in the art.

Comparison to Fiber Optic-Based Distributed Temperature Sensing

Fiber Optic-Based Distributed Temperature Sensing (DTS) involves sending laser pulses down the length of an optical fiber and then interpreting the spectrum of the back-scattered light. Local environmental differences—most notably temperature—cause changes to the back-scattered light; these changes can be interpreted to reconstruct a temperature profile along the length of the fiber.

To protect the relatively fragile fiber, it is usually placed within a stainless steel sheath. The sheath attenuates the temperature response—both reducing accuracy and increasing response times to temperature changes.

In conventional gas and oil production, DTS is not used to estimate relative production flow rates along a casing. Instead, it provides insight into the "gross" condition of the well. For example, geothermal temperature increases with distance from the surface. Warm fluid cools as it flows to the surface. All things being equal, the faster the fluid flows the less it cools as it rises, giving different profiles for different flows. Other phenomena can perturb the temperature profile. For example, Joule-Thompson heating/cooling (by large adiabatic pressure drop) at a flow restriction can cause a discontinuity in the profile.

In comparison to the present invention, DTS measures absolute fluid temperature, while the present invention measures local cooling of a (hot) thermistor element that is caused by fluid flowing over its surface. The faster the fluid flows (at constant fluid temperature), the more the element is cooled and the greater the energy input needed to keep it at constant temperature. Comparing power inputs within a network of sensors allows the present invention to make inferences about relative local flow rates.

As part of a sophisticated model of a well, optical fiber DTS can contribute to the operator's knowledge of sub-surface flow conditions. But DTS is significantly less reliable for local flow estimation (i.e., the success of fracs) than the system disclosed here.

Well Mechanical Integrity Monitoring Subsystem

When drilling and extracting natural gas and other fossil-based materials from deep wells in the Marcellus Shale and other shale/oil/gas complexes, an issue can arise in that gas, which has been generated in the deep earth at high pressure, can escape through fissures and paths caused through the drilling process and contaminate local underground water supplies and aquifers. This contamination of groundwater and aquifers can lead to health problems and safety problems for those residents, businesses, and entities that use the aquifer groundwater for domestic or industrial use (see below for a detailed discussion of the regulatory and liability landscape surrounding water contamination). The contaminant of the water supplies represents a significant unmitigated financial risk to the resource extractor. The most likely leakage pathway of gas from a well is through the water casing which may be caused by a leak or break in the cement casing which is designed to protect the water aquifer through which a gas well is drilled.

The subsystem described in this section monitors for a loss of the mechanical integrity of the natural gas production well itself, including the junctures of a completed well. The sensor network is capable of installation during well construction that will be able to monitor the well's mechanical integrity and determine whether there is a break or leak in the well's casing or cement. The current processes used to detect structural problems along a wellbore are expensive, time-consuming and complex.

This subsystem allows the well to be repaired as quickly as possible, minimizing the costs associated with diagnosis and stopping gas production. Breaks or leaks in a well's mechanical integrity that are not promptly fixed may impair natural gas extraction by depressurizing the well.

The design of wells drilled for hydrocarbon production have two main purposes: the prevention of fluids in non-target geologic formations from entering the well bore and the prevention of fluids from target formations from escaping the well bore. These purposes are accomplished through the design and construction of cemented casing strings. Casing is steel pipe of appropriate strength and thickness lowered into the drilled hole. On the outside of the pipe are centralizers, hardware designed to center the pipe in the hole. Inside, and at the bottom of the pipe, is other hardware used in the cementing process. To place the cement, concrete is forced down the inside of the casing pipe, which flows past the casing shoe located on the bottom of the pipe and up the outside of the pipe to either the surface or to some other predetermined elevation. When hardened, the cement forms a seal between the rock and the casing that prevents fluid (either gas or liquid) from flowing into the annulus of the well.

Figure 5:
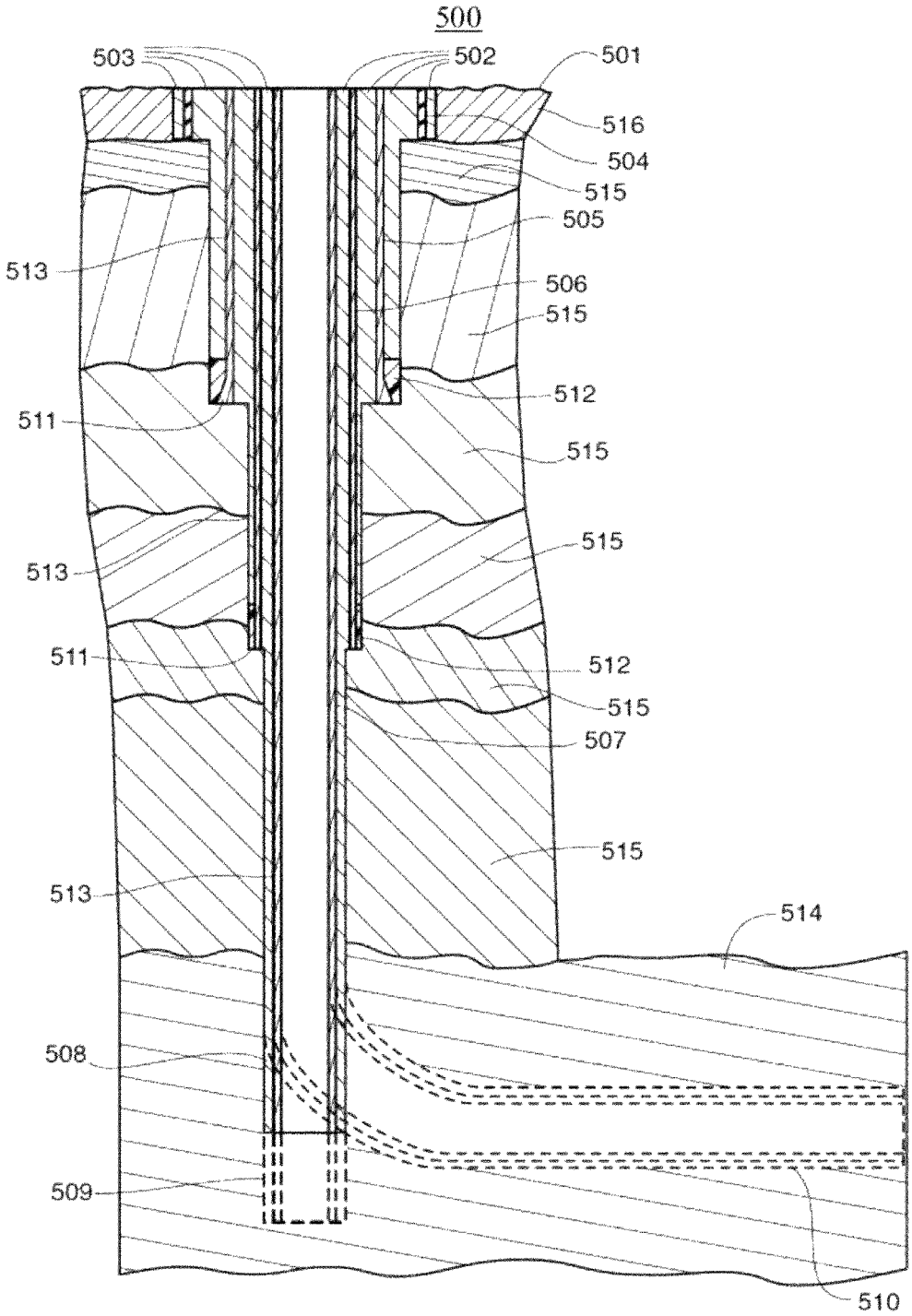
FIG. 5 shows a cross section of a generalized well segment showing locations of leakage detection sensors according to one embodiment of the present invention.

Depending on the geologic conditions penetrated by the well, there can be multiple casing strings concentrically located in the well. For instance, the 'foundation' of the well is the conductor pipe. It is a large diameter pipe extending several tens of feet into competent rock and cemented in place. Once the cement is set, a smaller diameter bit drills through the plug of cement at the bottom of the conductor pipe and continues down several hundred to more than a thousand feet. A freshwater casing, sometimes called the 'freshwater string' or 'primary string,' is placed and cemented. Once that cement has hardened, a still smaller bit is used to drill though the plug in the bottom and continues downward. If appropriate, another 'intermediate' casing string is cemented in place. Intermediate strings commonly isolate non-target hydrocarbon bearing formations, brine filled formations, coal seams, abandoned underground mine workings, or zones of incompetent rock or where drilling fluid circulation is lost. If an intermediate casing is used, then another, smaller bit is used to drill the plug at its bottom and continue further down toward the target formation. The well is completed when the target formation is reached. In most modern wells, production pipe is then cemented in-place. It is through the inside of this production pipe that the product flows from the target formation out of the well on its way to market. FIG. 5 shows an illustration of a typical shale gas well, showing a conductor pipe, a freshwater casing, an intermediate casing, and a production casing, as described in greater detail below.

Figure 6:
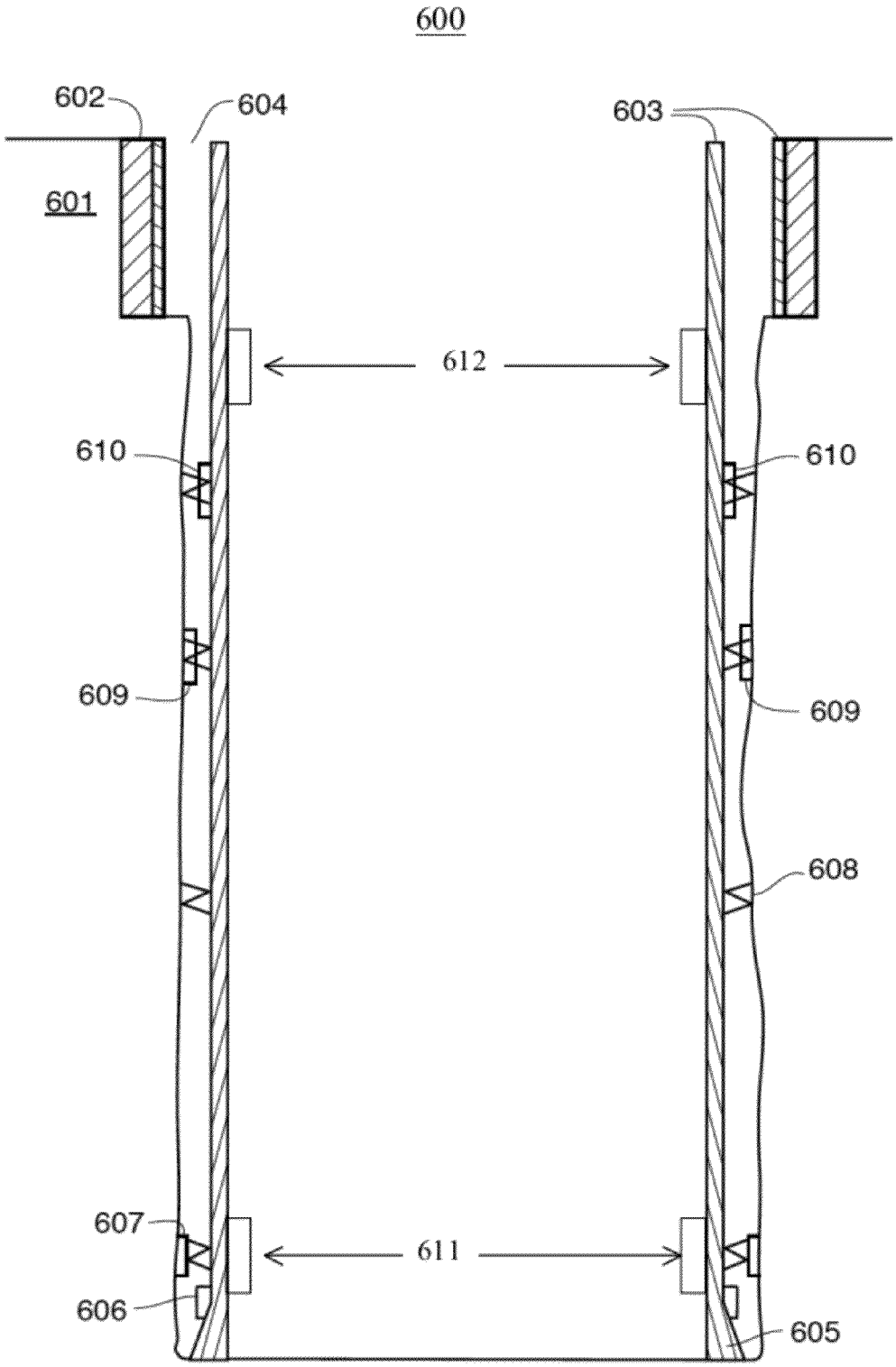
FIG. 6 shows a cross section of a casing string segment showing locations of leakage detection sensors according to one embodiment of the present invention.

This system of casing pipe and cement forms the 'mechanical integrity' of the well. Properly designed and constructed, the cemented casing is the primary protection of fresh groundwater resources from fluids used in drilling the deeper portions of the hole, prevents cross contamination between aquifers, prevents gas migrations from non-producing, but methane-bearing rock, and from failures in the production pipe that would otherwise allow the target hydrocarbons to escape containment. The casing string also prevents water from flowing into the well that could potentially 'kill' the production by hydrostatic pressure. FIG. 6 illustrates a cross-section of a casing string, described in greater detail below.

In the vast majority of wells, the design and construction work properly. However, failure in either can lead to significant problems. Gas escaping from the hole can migrate to homes either directly through fractures or as dissolved contaminates in groundwater. If such gases accumulate and mix with air, a dangerous explosion may occur. Other contaminants in ground water can pollute drinking water in domestic supplies or cause ecological damage in streams and lakes. A poorly designed well can create large legal liabilities for the well owner.

The concentric layers of steel casing pipe walls and cement make investigation of problems difficult. The pathway for fluid flow is inaccessible to direct observation. Indirect methods usually rely upon acoustic or sonic methodologies to test for poor bonding of the cement to the casing wall or to listen for sounds of movement. The uncertainty of the investigation method can make remediation of the problem uncertain as well. This uncertainty may result in considerable expense as ineffective or unnecessary remedial measures are taken. Properly constructed wells may be blamed for problems simply because proof of proper construction cannot be offered.

It is to address these problems that the well mechanical integrity monitoring subsystem was developed. Simply put, sensors capable of detecting the presence, and if necessary, the flux of fluids existing in the geologic strata penetrated by the hole are placed within the annulus of the well prior to cement placement. A communication subsystem (described below) is used to connect the sensors to the surface. After the casing is set and cemented, the sensors continuously monitor the mechanical integrity of the well. Direct measurement allows for early warning and targeted remediation of problems, definitive evidence of the mechanical integrity of the well, and proof against spurious liability claims. This system would also likely bring operators into compliance with new and anticipated regulatory requirements, such as those approved by the Pennsylvania Department of Environmental Protection (DEP) requiring operators to implement a quarterly monitoring program developed by the DEP for collecting mechanical integrity data [Pennsylvania Department of Environmental Protection (DEP) Regulatory Requirements, Chapter 78, Subchapter D, section 78.88]. This program is expected to require pressure monitoring associated with production casing and in annular space associated with production casing, and monitoring for leaking gas.

FIG. 5 shows a cross section 500 of a well segment showing a location of leakage detection sensors according to one embodiment of the present invention. The gas well is drilled from a surface 501 through host (non-producing) rock formations 515 to target (producing) rock formation 514, which could be a shale rock holding hydrocarbons such as methane. Cement 502 is used to seal steal casing pipe 503. The well is formed from a conductor pipe 504, freshwater casing 505, intermediate casing 506, and production casing 507. At kick-off point 508, the well may turn horizontally for horizontal shale wells. From kick-off point 508, the well may proceed vertically for a vertical well 509 or horizontally for a horizontal well 510. A casing shoe 511 is used to cement the steel pipes in place. A sensor 512 is placed at a casing shoe to detect leakage at the casing shoe. A second sensor 513 is placed at a location within the annular space of the cement casing to detect leakage at that location.

FIG. 6 shows a cross section 600 of a casing string showing locations of leakage detection sensors according to one embodiment of the present invention. In one embodiment of the present invention, flux sensors are placed near the shoe and on both the casing/cement and the rock/cement interfaces. A well is drilled through host rock formation 601. This figure shows the setting of the freshwater casing after the previous casing (or conductor pipe) 602 has been set. Steel pipe 603 represents the pipe from both the previous casing and the casing being currently set. An annulus space 604 exists between the steel casing pipe 603 and either previous casing 602 or host rock formation 601 prior to cement placement. Centralizers 608 are used during placement of the steel casing pipe to center the pipe inside the drilled well, and a casing shoe 605 is used to direct cement being poured into the pipe up the annular space 604. In one embodiment, a sensor 606 is placed at an inner shoe location for detecting leaks at the casing shoe 605. In another embodiment, a sensor 607 is also placed at an outer shoe location for detecting leaks at the casing shoe. In another embodiment, a sensor 609 is also placed at an outer centralizer location for detecting leakage out of the cement casing. In yet another embodiment, a sensor 610 is also placed at an inner centralizer location for detecting leakage out of the cement casing.

In yet another embodiment of the present invention, flow sensors analogous to the flow sensors described for the flow monitoring subsystem are placed at a bottom of the freshwater casing and at a top of the freshwater casing. For example, flow sensors 611 may be placed at a bottom location of the freshwater casing, and flow sensors 612 may be placed at a top location of the freshwater casing. By the law of conservation of mass, a difference in the flow of hydrocarbon fluids between the bottom and the top of the freshwater casing can be used to infer leakage of hydrocarbons from the well.

The connections of the sensors at the surface are not shown. In one embodiment, a communication subsystem as described below is utilized. The sensors can be connected above ground to a small, battery-powered communications control and power box that provides for real-time communications capability to either local cellular communications systems, to commercial satellite systems, or other yet to be evolved ubiquitous WiFi/wideband communications systems, or the like.

Safety Concerns Associated with Shale Gas Production

Fire Hazards: Because natural gas is combustible, leakage of gas from a wellbore can produce fire hazards. Gas seepage has led to fires and explosions in nearby residences causing property destruction and even injuries or fatalities. "Flammable faucets" have occurred when gas contaminates tap water to the extent that it literally ignites with exposure to flame.

Natural Gas Poisoning Hazards: Gas extraction may result in natural gas seepage from rock formations to the surface or into groundwater, and significant or prolonged exposure to natural gas is harmful. However, unless the leak is into a confined space the gas is quickly diluted, and gas evolves quickly from drinking water. Nevertheless, inhaled gas can directly damage the lungs, or gas can cause systemic toxicity after absorption through the gastrointestinal system (when present in drinking water) or respiratory system (when inhaled as a gas). With acute exposure, natural gas can cause loss of consciousness or death by decreasing the concentration of oxygen and increasing the concentration of carbon dioxide in the body. Natural gas is also readily absorbed into the circulatory system, and can cause central nervous system depression (e.g., lethargy, coma, inebriation), seizures, and dangerous changes to heart rhythm.

Other Toxic Exposure Hazards: Chemicals used to enhance the effectiveness of fracturing fluids are known to be hazardous to human health, and may contaminate drinking water supplies. This may occur where the chemicals are spilled on the surface before or during a hydraulic fracturing operation or when flowback fluids and production brines leak from the wellbore due to problems with the structural integrity of a well or when not properly disposed. Chemicals that have been used include known human carcinogens, chemicals regulated under the Safe Drinking Water Act for their risks to human health, and hazardous air pollutants regulated under the Clean Air Act. This includes methanol, 2-butoxyethanol (2-BE), formaldehyde, and diesel fuel. In addition to the chemicals used in fracturing fluids, naturally occurring substances in gas containing formations may be toxic to human health, such as mercury, lead, uranium, thorium, radium and arsenic. Gas extraction may release these substances into drinking water. Several cases of arsenic, lead, and heavy metal contamination have been reportedly associated with drilling operations. High-dose exposure to arsenic, for example, can cause severe systemic toxicity and death. Lower dose chronic exposure can result in skin changes, peripheral nerve damage, and liver toxicity. Long-term effects of arsenic exposure include an increased risk of cancers, even after exposure has ceased. High levels of radioactivity from radium have also been detected in fracturing wastewater; radium is known to cause bone, liver and breast cancers.

Groundwater Contamination Hazards: Groundwater supplies more than half of the drinking water in the United States. It is relied on for eighty percent of all rural water, forty percent of irrigation water, as well as twenty-five percent of all industrial water. Groundwater lies beneath the earth's surface in vast underground water collectors referred to as aquifers. Aquifers vary in geological make-up. Some are artesian, in which water is confined between layers of rock. Others are water table, or unconfined, aquifers, in which water flows freely throughout the saturated zone. Finally, some aquifers are solution channels, developed from bedrock cracks that function like pipes for transporting subsurface water. Groundwater that is chemically contaminated presents a serious public health risk, and the resulting pollution causes significant social and economic dislocation. In some cases, people must locate new water supplies and communities must undertake expensive groundwater decontamination projects. In addition, there are long-term, unpredictable costs of groundwater pollution. People exposed to contaminated groundwater may develop illness and their property values may decline. A process known as recharge cleanses groundwater naturally, in which water is drawn downward through the earth's subsurface layers while surrounding soil and rock act as filters removing and breaking down pollutants. This recharge process, however, does not remove inorganic pollutants. Chemical contaminants may remain until they are removed artificially. It may take months or years to decontaminate an aquifer, depending on the process used and the extent of the damage. Even when corrective action is taken, its effectiveness in reducing or eliminating the contamination is uncertain. The environmental harm resulting from even a small gas leak may be permanent [Heidi E. Brieger, *Lust and the Common Law: A Marriage of Necessity,* 13 B. C. Envtl. Aff. L. Rev. 521 (1986)].

Mainstream Media Recognition: Whether real or imagined, media reports of groundwater contamination due to natural gas extraction are now common and prominent. A documentary film "Gasland" which focuses on communities negatively impacted by natural gas drilling and hydraulic fracturing was nominated for an Academy Award. The New York Times ran a front-page story on Feb. 27, 2011 on the dangers posed by hydraulic fracturing.

Selected Case Studies in Alleged Contamination: The Pennsylvania Department of Environmental Protection determined that natural gas contaminated well water at two homes on private properties and ordered Catalyst Energy, Inc. to halt drilling and hydraulic fracturing at 36 non-Marcellus Shale wells in the area. The order requires Catalyst to halt all drilling operations on new wells and to conduct tests to determine which of the 22 wells it has already drilled in the area is responsible for the contamination. Catalyst was required by the Mar. 30, 2011 order to immediately provide temporary, whole-house water systems to the affected homes and to permanently restore or replace the water supplies by the first of July. [This case study is adapted from "State orders drilling halt after 2 wells are polluted in Forest County," Tuesday, Apr. 5, 2011; Don Hopey, *Pittsburgh Post-Gazette.]*

Additional Selected Case Studies in Alleged Contamination: Fifteen families in Dimock, Pennsylvania sued Cabot Oil & Gas in the U.S. District Court. The families seek a permanent injunctive order to ban the drilling processes blamed for contamination of their well water. The families claim that Cabot Oil contaminated their water wells with toxic chemicals. Plaintiffs claim they have suffered neurologic, gastrointestinal, and dermatologic symptoms from exposure to tainted water and seek compensatory damages in the form of a trust fund to cover their medical expenses. They also claim that they have had blood test results documenting exposure to heavy metals. According to the initial complaint filed by the plaintiffs, Cabot's drilling allowed methane to escape into private water wells, and in two cases, caused wellhead explosions due to gas build-up. In April 2010, the state of Pennsylvania had banned Cabot Oil from further drilling in the entire state until it plugged wells believed to be contaminating local groundwater. The order was the result of an investigation that concluded Cabot Oil "had allowed combustible gas to escape into the region's groundwater supplies."

Residents in the town of Dish, Tex. have reported deteriorating health as a result of local hydraulic fracturing operations. The town funded a water quality study conducted by a private environmental consultant that showed high levels of carcinogens and neurotoxins in local drinking water. Property values have also dropped as a result of gas extraction.

Residents in Pavillion, Wyo. have claimed their wells were contaminated by natural gas shortly after hydraulic fracturing took place nearby. The EPA conducted an investigation between March and May of 2009 and found that at least three wells in Pavillion contained contaminants used in the natural gas drilling process; eleven other wells of the thirty-nine tested contained traces of other contaminants, including oil, gas and metals.

In Silt, Colo., Laura Amos claimed she developed a rare adrenal gland tumor as a result of local hydraulic fracturing operations. Mrs. Amos claimed that a chemical 2-BE had been used in fracturing operations, which is known to cause tumors of the adrenal gland. An EnCana spokesman claimed that 2-BE was not used in nearby fracturing operations, however, it later emerged that 2-BE had in fact been used to permeate the formation from which Mrs. Amos' water supply derived as part of an experimental project. In 2006, Laura Amos accepted a reported multimillion-dollar settlement from EnCana. The company was fined $266,000 for "failure to protect water-bearing formations." A number of local residents have since come forward with claims of illness related to gas drilling. [Case studies are adapted from "Communities that have Experienced Hydraulic Fracturing Methods," Mar. 25, 2010; Otsego 2000, Inc.]

Federal Regulation of Hydraulic Fracturing: In 1997, the Eleventh Circuit decided LEAF v. U.S. Environmental Protection Agency, 118 F.3d 1467 (11$^{th}$ Cir. 1997), concluding that the hydraulic fracturing of coalbeds constituted "underground injection." This brought the practice under the jurisdiction of the federal Safe Drinking Water Act (SDWA). As a result of this ruling, the EPA conducted its first major study analyzing the impact of hydraulic fracturing on drinking water quality in *Evaluation of Impacts to Underground Sources of Drinking Water by Hydraulic Fracturing of Coalbed Methane Reservoirs Study* (2004). The study stated that "the injection of hydraulic fracturing fluids into coalbed methane wells poses little threat to [underground sources of drinking water]." In the Energy Policy Act of 2005, Congress specifically exempted "the underground injection of fluids or propping agents (other than diesel fuels) pursuant to hydraulic fracturing operations related to oil, gas or geothermal production activities" from regulation under the SDWA. This became known as the "Halliburton exception" to the Safe Drinking Water Act. In March of 2010, however, the EPA announced that it would be undergoing a revised fracking study to analyze "the full lifespan of water in hydraulic fracturing," from the acquisition of water through its ultimate treatment and disposal. The EPA will issue preliminary research results by the close of 2012, with a full report to follow in 2014. Until such study is completed, Congress is unlikely to repeal the fracking exception in the SDWA. Natural gas drilling has been exempt from other environmental protection laws, such as provisions of the Clean Water Act, Clean Air Act, National Environmental Policy Act (NEPA), and Resource Conservation and Recovery Act (RCRA). Both the House of Representatives (H.R. 2766) and the Senate (S. 1215) have introduced legislation—the FRAC Act—to overturn the exemption of hydraulic fracturing from the Safe Drinking Water Act and to require the public disclosure of the chemicals in fracking fluids. [Adapted from "Take It Easy On Fracking," Mar. 15, 2011; Law360, New York.]

State Regulation of Hydraulic Fracturing: In the absence of strong federal regulation, states and municipalities have attempted to regulate fracking. Primarily, this has occurred in states housing the largest shale gas formations. On Feb. 23, 2011, the New York State Assembly proposed a bill that would bar any new permits for horizontal fracking until the release of the proposed EPA report. In October 2010, then Governor Ed Rendell instituted a ban on the leasing of additional state lands for fracking in Pennsylvania. Two cities in New York and Pennsylvania, Buffalo and Pittsburgh, have independently instituted bans on fracking within the city limits. Some state regulations require full disclosure of the chemical constituents in hydraulic fracturing fluids. In September 2010, Wyoming became the first state to require full disclosure of the chemicals included in a company's proprietary fracking formula. Montana declined to adopt a similar law. [Adapted from "Take It Easy On Fracking," Mar. 15, 2011; Law360, New York.]

Litigation and Liability Associated with Hydraulic Fracturing: There has been a recent increase in fracking related litigation. In November of 2009, for example, fifteen families in Pennsylvania filed suit against Cabot Oil & Gas Corp., alleging that Cabot polluted their the plaintiffs and $500,000 to the Pennsylvania Department of Environmental Protection. In September of 2010, thirteen families in Pennsylvania filed suit against Southwest Energy Co., alleging that Southwest's hydraulic fracturing practices resulted in property damage and personal injury. The families have brought claims under Pennsylvania's Hazardous Sites Cleanup Act, in addition to private nuisance and trespass claims, negligence, and strict liability claims, and are seeking a preliminary and permanent injunction to bar Southwest Energy from continued drilling. Two suits alleging similar theories of liability were filed in Texas in December of 2010 regarding hydraulic fracturing practices in the Barnett Shale. The potential for liability arising from hydraulic fracturing does not stop at toxic tort claims. Claims may also be brought under the federal Comprehensive Environmental Response, Compensation and Liability Act of 1980 (CERCLA). Congress enacted CERCLA in 1980 to address sites that were contaminated by hazardous waste disposal. Under CERCLA, the EPA can act on its own behalf and cleanup sites or it can order Potentially Responsible Parties (PRPs) to clean up the site. If the government chooses to clean up the site itself, it may pay for the costs out of a self-created "Superfund." In turn, the government may sue PRPs for the costs it incurs. The liability of PRPs for damages and response costs is capped at $50 million. However, if the chemical release was a result of negligence, misconduct, or a "violation of . . . safety, construction or operating standards or regulations," the PRP may be responsible for the "full and total costs of response and damages." In addition, PRPs can be liable for punitive damages if they fail to properly provide removal or remedial action after being ordered to do so. CERCLA imposes strict, joint and several liability for the contamination of soil and water through hazardous substances, defined under the act. [Adapted from "Take It Easy On Fracking," Mar. 15, 2011; Law360, New York.]

Aquifer Monitoring Subsystem

By measuring pre- and post-drilling water quality, the aquifer monitoring subsystem helps clients to understand the impact of shale gas drilling on the local environment and to allow proactive and corrective action when necessary. An embodiment of the system is being field-tested at Loyalhanna Watershed Association, supported by a grant from the Foundation for Pennsylvania Watersheds.

Overall design goals were to develop a low maintenance system capable of monitoring water samples for years with minimal maintenance requirements. The system design is constrained by the following requirements:

Ability to support multiple sensors

Open technology capable of adding new sensors

Low maintenance and power consumption

Battery powered and able to recharge via wind, solar, or utility power where available Unmanned monitoring that transmits alerts to e-mail, cell phone, text message, etc.

Capable of using cellular, satellite, or hardwired Internet service for communication where available Compact sensor size that can fit into a typical monitoring shaft or water well, or a flow-through configuration allowing water samples to be pumped to the surface and sent through the sensor above-ground The subsystem described herein, which may be used to establish a baseline condition, acts to monitor and alert upon potential contamination of groundwater via natural gas or methane migration or other contaminants associated with gas and oil extraction. The system, which consists of sensors, a signal conditioner, a remote communications system, a data collection and analysis center, and an emergency response center, has been designed to minimize liability to the gas extraction entity while providing protection for land and home owners.

The initial field test system consists of a number of sensors that measure methane, specific conductivity, turbidity, and temperature. The sensors are connected to a datalogger with wireless connectivity to a response center. The front-end software allows customers to view the state of all sensors online via a web interface, while the middleware processes and stores sensor data and sends alerts for pre-specified conditions. One supplier of a methane sensor currently used in one embodiment of the present invention is FRANATECH®. If placed outdoors, the entire system may be housed in a weatherproof NEMA enclosure.

Figure 7:
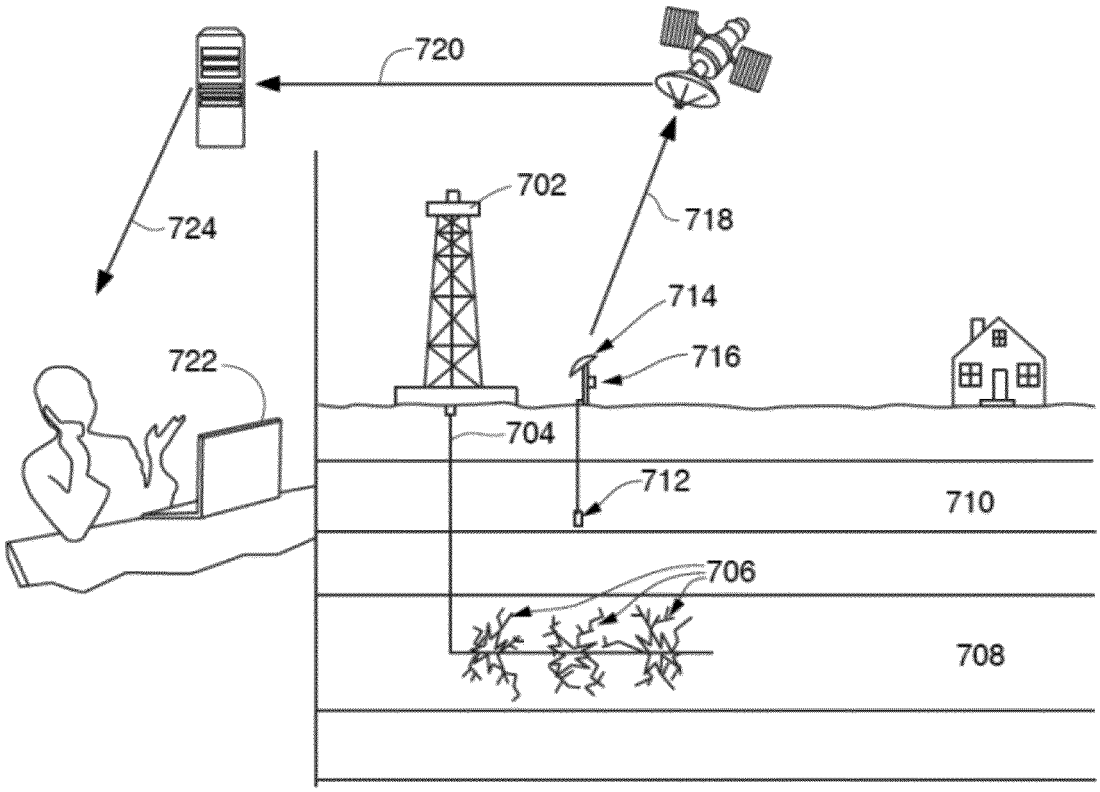
FIG. 7 shows an illustrative system architecture of an aquifer monitoring subsystem according to one embodiment of the present invention.

The system communicates an alert condition when a predetermined data value exceeds a predetermined threshold. The system also communicates once per day to acknowledge proper operational status. The central server can collect data from numerous sites and relay alerts to analysts using e-mail or text messaging. FIG. 7 shows an overview of a system architecture according to one embodiment of the present invention, and described in greater detail below.

The system can accommodate multiple sensors that can be utilized in a "plug and play" interface. The modular architecture of the system permits different sensors to be deployed depending on individual client needs and resources. Sensors may be integrated that can measure methane, seismic motion, temperature, and other indicators of contamination (such as total dissolved solids (TDS), total suspended solids (TSS), pH, barium, chloride, iron, manganese, total organic carbon, sodium, strontium, oil/grease, detergents, lead, arsenic, alkalinity, coliform bacteria, sulfate, nitrate, BTEX, gross alpha, radon, and radium).

In one embodiment, water samples are transported to instrumentation above ground, and the sensors are configured in flow-through configurations where the water flows through the sensor in order to take a measurement rather than the sensor being placed underground.

As shown in FIG. 7, in the event contamination is detected, the system immediately goes into transmission mode and transmits a repeating warning signal that alerts operators to a potential problem. This warning signal, which is monitored at a Response Center, run by a non-profit organization such as CONCURRENT TECHNOLOGIES CORPORATION® (CTC), allows homeowners, industrial concerns, and local gas producers to quickly respond to ascertain the extent and potential effects of the contamination. The transmission boxes are intended to be totally sealed, tamper proof, highly reliable systems that can be easily upgraded as technology changes over the course of the 30 to 40 years that is expected for the probes and sensors to be operable. The probes are designed to be easily replaced, as technological advances will likely require replacements over the life of the resource extraction process. Forty years is the maximum time that has been projected for extracting natural gas from a Marcellus or other shale deposit. The sensor system may be in operation far beyond the duration of the extraction activities in order to minimize undetected risks to the aquifer.

The system is designed so that it will "chirp" on a regular basis, generally once a day, to validate that the overall system is healthy and that it is working properly. In the case of a detection of contamination above the threshold set by the administrator, the system will immediately go to a transmission mode and it will transmit a repeating warning signal that alerts operators to a potential problem.

FIG. 7 shows an illustrative system architecture 700 according to one embodiment of the present invention. A pad 702 is used to drill a well 704 that extends vertically and then horizontally into shale 708, with fractures 706 produced in the horizontal portion of the well. An aquifer 710 overlies the shale formation 708. A sensor unit 712 is inserted into a monitoring well that extends into the water aquifer 710. Alternatively, a pump (not shown) may be used to pump water from the monitoring well up to the surface, where the water is passed through a sensor setup in a flow-through configuration. A solar cell or other power source 714 provides power to data logger 716 and related communications equipment. Data 720 can be sent from the data logger 716 to a data center via cellular, satellite 718, or other communication means known in the art. Alerts 724 may be generated to analysts 722, gas producers, homeowners, businesses, or other parties of interest as determined by the system administrator.

Figure 8:
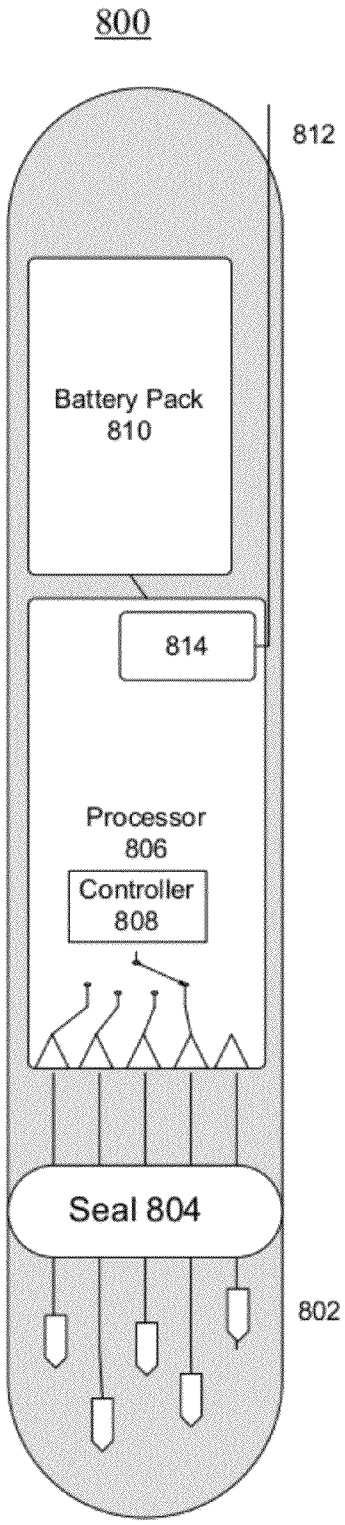
FIG. 8 shows an illustrative multi-sensor probe according to one embodiment of the present invention.

FIG. 8 shows an illustrative multi-sensor probe 800 according to one embodiment of the present invention. In one embodiment of the invention, a custom multi-sensor probe 800 contains several miniaturized sensors 802 along with a low power processor 806 (such as the TI-MP430) and a battery pack 810. The processor 806 converts analog sensor values to digital data and transmits it using a common connection 812. The design allows for expandability for new sensors. All of the sensors are isolated from the electronics using a hermetic seal 804. The processor 806 switches out of sleep mode periodically to perform measurements from the sensors 802 via a controller 808. The processor 806 then transmits the data via a tethered cable 812 using an open communication standard (such as Modbus) via communication module 814 before resuming back to sleep mode. The entire unit is to be housed in a casing small enough to fit in a monitoring shaft that typically has a 1" to 2" radius. The unit can be made long enough to fit numerous sensors 802 horizontally staggered. The system may contain multiple microsensors to detect a broad range of potential contaminants.

If the sensors are installed at the beginning of the drilling process, then a baseline can be measured and gas producers can validate, over the life of the well, that they have not contaminated groundwater. These sensors will additionally be able to discriminate between contamination due to naturally occurring surface methane and methane released by the drilling process. The sensors can be monitored by a not-for-profit independent organization, such as CTC, and this could be on a statewide or nationwide basis, that organization would be responsible for reporting trends, activities, and maintaining valid data records from the sensors for impartiality purposes.

One unique attribute of this system is an integrated distributed network of low-cost, self-powered sensors monitoring water aquifers, together with a response and monitoring center that is fully automated for alerting all parties potentially affected by contamination of groundwater and a system that is readily upgradable, maintainable, has minimal maintenance requirements, is tamperproof and can be relied on to provide validated information, both for safety and cost mitigation.

Typically for a Marcellus Shale operation, a small pad would facilitate multiple extraction heads that would be drilled and then transverse drilled into the shale structure below the well head covering an anticipated area of several thousands of feet, up to 1 mile, in radial direction away from the well head. Thus, for a given well, one could assume a circular pattern of gas extraction extending up to 1-mile in radius from the well head. In order to properly measure the aquifer in this area, a sensor package can be installed at each known well within the 1-mile radius and selectively drilled pilot wells around the periphery would assure statistical and valid measurement of any potential contamination. Generally, the aquifer layers will be only a few hundred feet deep and installation of the proposed sensors into existing wells can be done at minimal cost and expense.

Figure 9:
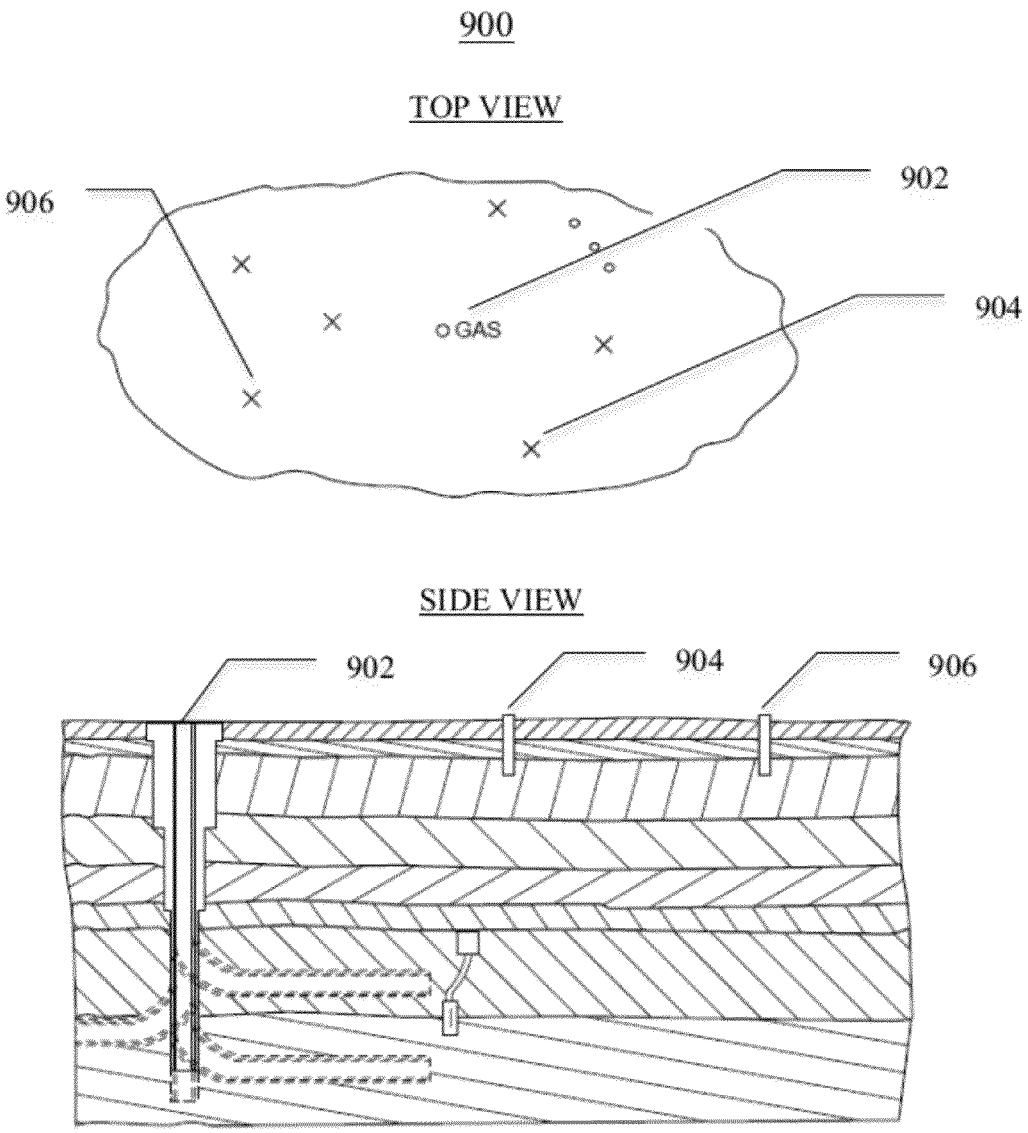
FIG. 9 shows an illustrative setup of an aquifer monitoring subsystem according to one embodiment of the present invention.

FIG. 9 shows an illustrative setup of an aquifer monitoring subsystem according to one embodiment of the present invention. Disclosed herein is a system comprising a series of sensors for measuring water in an aquifer to detect potential hydrocarbon contamination (primarily methane and ethane). In one embodiment, the sensor consists of a long sealed coil that is pushed down through either existing water well casings or small instrumentation bore holes into the aquifer and has at the end a sensor specifically designed to detect methane in well water or the aquifer (as described in relation to FIG. 8). A complex multiple sensor system can also be installed that can detect not only natural gas and methane, but also other potential hydrocarbon contaminants and other contaminants. These other sensors would include biological contaminant sensors, heavy polymer contamination sensors, such as would come from contamination due to fracking water, and microseismic sensors to detect ground movement.

In one embodiment of the present invention and as shown in FIG. 9, one or more monitoring wells (e.g., 904 and 906) are installed in and around the pad 902. The monitoring wells (904 and 906) are used to detect hydrocarbon and other fracking constituents leaking from the freshwater casing into the water aquifer underlying the pad. This allows for immediate and proactive alerting in the case of a leak in the cement casing, and allows a gas producer to show that his pad is not the cause of a leak in those situations where methane is migrating from a source other than the gas producer's pad. In one embodiment, each monitoring well comprises a down-hole probe adapted to detect at least methane, ethane, propane, and butane to generate a fingerprint identification of the producing pad adapted to identify a particular source of contamination. This fingerprint identification can later be used to dispute false claims of contamination. In one embodiment, instead of placing the sensor down-hole in the monitoring wells, the water is brought up to the surface via a pump and is flowed through a series of sensors configured in a flow-through configuration.

In addition, the sensors will generate data on underground geology to provide a map of natural gas flows, water resources, and other geologic formations to ease future drilling operations. There is substantial value in collecting, maintaining, and interpreting this data over time.

Field Test of Aquifer Monitoring Subsystem

A field test of one embodiment of the present invention was conducted at a water well in the Loyalhanna Watershed Association region, funded on a grant by the Foundation for Pennsylvania Watersheds. Founded in 1971, the Loyalhanna Watershed Association (LWA) strives to achieve its mission to protect, conserve and restore the natural resources of the Loyalhanna Creek Watershed via the coordinated efforts of over 900 members, 15 Board Directors comprised of all dues-paying members, three full-time staff and the support of several environmental partners. Comprised of over 2,500 miles of waterways draining 300 square-miles of land, the watershed flows north from its headwaters near Stahlstown, to Saltsburg, Westmoreland County, Pennsylvania.

Four major divisions of LWA's activities include water protection, land conservation, environmental education and community outreach. Specifically, LWA is active in addressing environmental issues through monitoring streams and abandoned mine drainage (AMD) discharges, implementing restoration projects for impacted waterways, educating local citizens, and maintaining recycling and cleanup efforts in communities throughout the watershed.

LWA worked with HydroConfidence and the present inventors to install one embodiment of a system to monitor for groundwater contamination of methane associated with Marcellus gas extraction in private water well sources. Methane monitoring will further LWA's understanding of the impact of shale gas drilling on the local environment and will protect Pennsylvania's healthy water aquifers.

A sensor system was installed in the Loyalhanna Creek Watershed to monitor for methane migration potentially associated with natural gas extraction. The methane sensor system was installed in a private water well near permitted Marcellus shale drilling sites to avoid the expense of drilling a new monitoring well. The system included a specialized methane sensor from FRANATECH™ that is designed to detect methane at levels down to 1 ppm in water.

The sensor was connected to a datalogger with wireless connectivity to the Internet. The software middleware and front-end were developed by a team of software developers from Carnegie Mellon University. The front-end allows customers to view the state of all sensors online via a web interface, and the middleware processes and stores sensor data and send alerts on pre-specified conditions.

The system communicates an alert condition when any data value exceeds a predetermined threshold. The system also communicates once per day to acknowledge proper operation status. The central server, which is located in the cloud, can collect data from numerous sites and relay alerts to analysts using e-mail or text messaging.

In the event contamination is detected, the system will immediately go to a transmission mode and it will transmit a repeating warning signal that alerts operators to a potential problem. This warning signal could alert CTC, HydroConfidence, LWA, the Pennsylvania Department of Environmental Protection (DEP), local gas producers and homeowners to quickly respond to ascertain the extent and the potential effects of the contamination. The system administrator can set who receives the alerts and under what conditions.

The outcome of this field test is a dataset comprising measurements of methane levels taken from a groundwater location in the Loyalhanna Creek Watershed near Marcellus drilling activity. This dataset will help LWA to understand the impact of shale gas drilling on the local environment, and, in the event no critical methane levels are detected during the lifetime of this field test, the data collected will be useful to establish baseline methane levels in the watershed. At the time of the submission of the present patent application, the field test was still in progress.

As an early warning system, the HydroConfidence system will help to prevent environmental damage, and will minimize the impact of any potential damage that may occur to hundreds of miles of streams in the Loyalhanna Creek Watershed.

Fingerprinting Contamination

An important benefit of the system disclosed herein is the ability to demonstrate whether contamination is coming from a client well. If contamination of local groundwater occurs, well owners have a vital interest in demonstrating their well isn't the source of contamination. Without evidence to this effect, well owners may face liability and have to halt gas extraction regardless of whether their well is actually causing contamination. For example, in the Commonwealth of Pennsylvania, United States, a presumed liability regime exists for contamination for water wells within 1,000 feet of drilling and within 6 months of the completion of drilling operations. The gas operator is presumed liable unless he or she can prove that they were not the cause of the contamination.

In one embodiment of the present invention, the ability of the sensors to accurately measure relative concentrations of hydrocarbon constituents (e.g., methane, ethane, propane, butane) allows for "fingerprinting" of the gas. This permits the present system to affirmatively demonstrate that a client well is not the source of contamination in cases where other sources of methane migration are responsible for high methane levels, such as naturally occurring methane, coal seams, landfills, septic tanks, or another producer's wells.

In one embodiment of the present invention, placing monitoring wells in the pad for monitoring the water aquifer below a pad as described above can be used for the purposes of fingerprinting a source of contamination and to prove that a given pad, or well, is not responsible for an alleged contamination.

Communication Subsystem

Once the data has been collected, it is necessary to transmit the signal from the sensors to the surface. This may be accomplished with a variety of means, including the means described below. It should be well understood by one of ordinary skill in the art that the communication subsystem described here is just one method by which signals can be sent from the sensors to the surface, and other signaling systems are within the spirit and scope of the present invention. For example, a coaxial cable or fiber optic inserted down the inside of the pipe could be used to transmit signals from the sensors to the surface.

Figure 10:
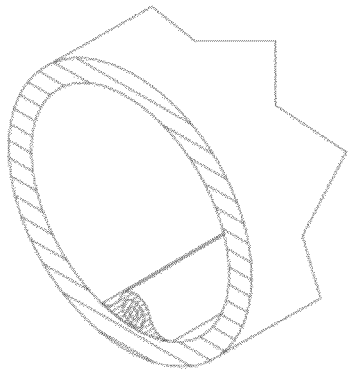
FIG. 10 show an illustrative casing string communication subsystem according to one embodiment of the present invention.
Figure 10:
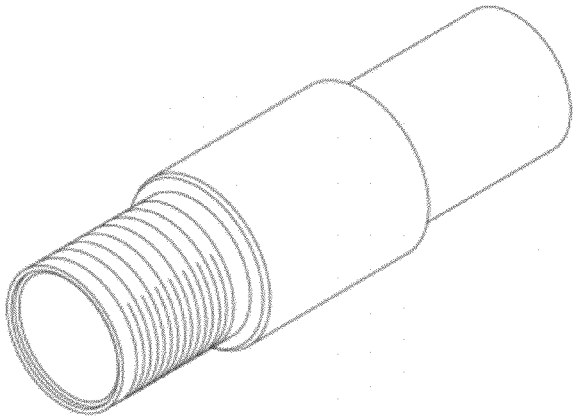
Figure 10:
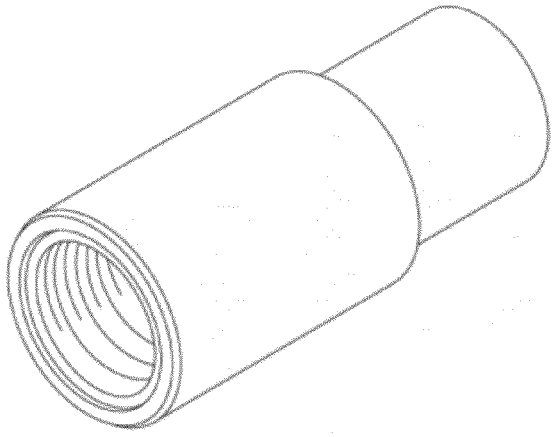

The communication subsystem is used for transmitting data to surface from the sensors and for providing power to the sensors located subsurface. In one embodiment of the present invention, a plurality of casing pipe segments is used to transmit the data and power. Each casing pipe segment 1002 has a communication cable for transmitting data and power along a length of the casing pipe segment, as shown in FIG. 10. An interconnect (electrical, magnetic, or electromagnetic) is provided at each end of each casing pipe segment 1020 and 1040 for transmitting data and power between adjacent casing pipe segments 1020 and 1040.

One system by which signals may be sent from subsurface sensors to the surface is described in U.S. Pat. Nos. 6,670,880, 6,717,501, 6,844,498 and 7,098,802, all by David R. Hall et al., the entirety of all of which is hereby incorporated by reference herein.

Therefore, in summary, one embodiment of the present invention is a system for monitoring flow of hydrocarbon fluids in a shale gas formation and for detecting leakage and methane migration from a producing pad, the system comprising a downhole communication subsystem comprising a plurality of casing pipe segments (casing pipe segments 1002, 1020, 1040 in FIG. 10), a downhole sensor subsystem, and an aquifer monitoring subsystem. The system comprises at least two first flow semiconductor sensors (sensors 208 in FIG. 2) embedded in a horizontal lateral of the casing pipe segments, each first flow sensor located between adjacent fracture stages (stage 222 in FIG. 2 and the next subsequent stage) of said horizontal lateral, said first flow sensors adapted for direct local measurement of relative flow at one or more specific locations between adjacent fracture stages; and at least two second flow semiconductor sensors (sensors 206 in FIG. 2) embedded in the horizontal lateral of the casing pipe segments, each second flow sensor located within a fracture stage between adjacent fracture clusters (clusters 218 and 220 of FIG. 2) of said horizontal lateral, said second flow sensors adapted for direct local measurement of relative flow at one or more specific locations between adjacent fracture clusters. The system also comprises at least three circumferential flow sensors (sensors 452, 456, 462 in FIG. 4B) arranged in a circumference in the horizontal lateral of the casing pipe segments adapted to measure a flow of gas, produced water, and gas condensate of the shale gas formation, with at least one of the three circumferential flow sensors located at a gravity bottom of the horizontal lateral of the casing pipe segments (sensor 452 in FIG. 4B); and one or more processors for measuring direct local flow data from the two first flow sensors and the two second flow sensors and providing said flow data to the downhole communication subsystem for transmission to surface, and for measuring direct local flow data from the three circumferential flow sensors to determine a relative concentration and flow rates of the gas, the produced water, and the gas condensate, wherein said first and said second flow sensors generate local data on direct flow rates of hydrocarbons from each fracture stage and each fracture cluster. The system also comprises at least two fourth flow sensors located at a bottom portion (sensors 611 in FIG. 6) and a top portion (sensors 612 of FIG. 6) of a freshwater casing of the casing pipe segments for detecting a loss of mechanical integrity of the freshwater casing and leakage of hydrocarbon fluids from the freshwater casing by measuring a difference in a flow rate measured at the top portion and at the bottom portion of the freshwater casing; and a network of monitoring wells (wells 904 and 906 in FIG. 9) installed in and around the producing pad (pad 902), each monitoring well comprising a downhole probe (probe 800 in FIG. 8) adapted to detect at least methane, ethane, propane, and butane to generate a fingerprint identification of the producing pad adapted to identify a particular source of contamination. Finally, the system also comprises a surface communications system (communications system 108 in FIG. 1) for collecting data from the downhole sensor subsystem via the downhole communication subsystem and the network of monitoring wells (wells 904 and 906 in FIG. 9) installed in and around the producing pad; and a datacenter for receiving communications from the producing pad (data 720 in FIG. 7) and generating one or more alerts (alerts 724 in FIG. 7) for potential methane migration, wherein the fingerprint identification of the producing pad and the downhole sensor subsystem are adapted to be used to dispute false claims of contamination.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

While the present invention has been particularly shown and described with reference to embodiments thereof, it will be understood by those skilled in the art that various other changes in the form and details may be made without departing from the scope of the present invention as defined by the claims.

What is claimed is:

1. A system for monitoring flow of hydrocarbon fluids in a shale gas formation and for detecting leakage and methane migration from a producing pad, the system comprising a downhole communication subsystem comprising a plurality of casing pipe segments, a downhole sensor subsystem, and an aquifer monitoring subsystem, the system comprising:

at least two first flow semiconductor sensors embedded in a horizontal lateral of the casing pipe segments, each first flow sensor located between adjacent fracture stages of said horizontal lateral, said first flow sensors adapted for direct local measurement of flow at one or more specific locations between adjacent fracture stages;

at least two second flow semiconductor sensors embedded in the horizontal lateral of the casing pipe segments, each second flow sensor located within a fracture stage between adjacent fracture clusters of said horizontal lateral, said second flow sensors adapted for direct local measurement of flow at one or more specific locations between adjacent fracture clusters;

at least three circumferential flow sensors arranged in a circumference in the horizontal lateral of the casing pipe segments adapted to measure a flow of gas, produced water, and gas condensate of the shale gas formation, with at least one of the three circumferential flow sensors located at a gravity bottom of the horizontal lateral of the casing pipe segments;

one or more processors for measuring direct local flow data from the two first flow sensors and the two second flow sensors and providing said flow data to the downhole communication subsystem for transmission to surface, and for measuring direct local flow data from the three circumferential flow sensors to determine a relative concentration and flow rates of the gas, the produced water, and the gas condensate, wherein said first and said second flow sensors generate local data on direct flow rates of hydrocarbons from each fracture stage and each fracture cluster;

at least two fourth flow sensors located at a bottom portion and a top portion of a freshwater casing of the casing pipe segments for detecting a loss of mechanical integrity of the freshwater casing and leakage of hydrocarbon fluids from the freshwater casing by measuring a difference in a flow rate measured at the top portion and at the bottom portion of the freshwater casing;

a network of monitoring wells installed in and around the producing pad, each monitoring well comprising a downhole probe adapted to detect at least methane, ethane, propane, and butane to generate a fingerprint identification of the producing pad adapted to identify a particular source of contamination;

a surface communications system for collecting data from the downhole sensor subsystem via the downhole communication subsystem and the network of monitoring wells installed in and around the producing pad; and a datacenter for receiving communications from the producing pad and generating one or more alerts for potential methane migration, wherein the fingerprint identification of the producing pad and the downhole sensor subsystem are adapted to be used to dispute false claims of contamination.

2. The system of claim 1, further comprising:

at least two third flow sensors, each third flow sensor located between adjacent fracture holes of said horizontal lateral, said third flow sensors adapted to measure flow between adjacent fracture holes to determine a success of individual fractures.

3. The system of claim 1, wherein the flow sensors are thermistors.

4. The system of claim 1, wherein the flow sensors are negative temperature coefficient thermistors.

5. The system of claim 1, wherein the flow sensors are positive temperature coefficient thermistors.

6. The system of claim 1, further comprising:

a mechanical integrity monitoring subsystem adapted to monitor for a loss of mechanical integrity of the casing pipe segments forming a freshwater casing.

7. The system of claim 6, further comprising:

a flow sensor for measuring flux of hydrocarbons out of the casing pipe segments forming the freshwater casing, wherein the loss of mechanical integrity of the freshwater casing is detected by the measurement of flux of hydrocarbons out of the freshwater casing.

8. The system of claim 6, further comprising:

at least one fourth flow sensor located at a bottom portion of the freshwater casing; and at least one fifth flow sensor located at a top portion of the freshwater casing, wherein the loss of mechanical integrity of the freshwater casing is detected by a difference in a flow rate measured at the top portion of the freshwater casing and a flow rate measured at the bottom portion of the freshwater casing.

9. The system of claim 1, further comprising:

an aquifer monitoring subsystem adapted to monitor a water aquifer overlying the shale gas formation for hydrocarbon contaminants leaking from the casing pipe segments.

10. The system of claim 9, further comprising:

a methane sensor adapted to monitor the water aquifer overlying the shale gas formation for methane leakage from the casing pipe segments.

11. A system for monitoring flow of hydrocarbon fluids in a horizontal lateral production casing of a shale gas formation and for detecting leakage and methane migration from a producing pad, the system comprising a downhole communication subsystem, a downhole sensor subsystem embedded in the horizontal lateral production casing and connected to the downhole communication subsystem, and an aquifer monitoring subsystem, the system comprising:

at least two first flow semiconductor sensors, each first flow sensor located between adjacent fracture clusters of said horizontal lateral, said first flow sensors adapted to measure relative flow between adjacent fracture clusters;

one or more processors for measuring temperature and flow data from the two flow sensors and providing said temperature and flow data to the downhole communication subsystem for transmission to surface, wherein said first flow sensors generate data on relative flow rates of hydrocarbons from each fracture cluster;

a network of monitoring wells installed in and around the producing pad, each monitoring well comprising a downhole probe adapted to detect at least methane, ethane, propane, and butane to generate a fingerprint identification of the producing pad adapted to identify a particular source of contamination; and a surface communications system for collecting data from the downhole sensor subsystem via the downhole communication subsystem and the network of monitoring wells installed in and around the producing pad for transmission to a datacenter, wherein the fingerprint identification of the producing pad and the downhole sensor subsystem are adapted to be used to dispute false claims of contamination.

12. The system of claim 11, further comprising:

at least two second flow sensors, each second flow sensor located between adjacent fracture holes of said horizontal lateral, said second flow sensors adapted to measure flow between adjacent fracture holes to determine a success of individual fractures.

13. The system of claim 11, further comprising:

a mechanical integrity monitoring subsystem adapted to monitor for a loss of mechanical integrity of the casing pipe segments forming a freshwater casing.

14. The system of claim 13, further comprising:

a second flow sensor for measuring flux of hydrocarbons out of the casing pipe segments forming the freshwater casing, wherein the loss of mechanical integrity of the freshwater casing is detected by the measurement of flux of hydrocarbons out of the freshwater casing.

15. The system of claim 13, further comprising:

at least one second flow sensor located at a bottom portion of the freshwater casing; and at least one third flow sensor located at a top portion of the freshwater casing, wherein the loss of mechanical integrity of the freshwater casing is detected by a difference in a flow rate measured at the top portion of the freshwater casing and a flow rate measured at the bottom portion of the freshwater casing.

16. The system of claim 11, further comprising:

an aquifer monitoring subsystem adapted to monitor a water aquifer overlying the shale gas formation for hydrocarbon contaminants leaking from the casing pipe segments.

17. The system of claim 16, further comprising:

a methane sensor adapted to monitor the water aquifer overlying the shale gas formation for methane leakage from the casing pipe segments.

* * * * *